US006478015B2

(12) United States Patent
Oki et al.

(10) Patent No.: US 6,478,015 B2
(45) Date of Patent: Nov. 12, 2002

(54) VAPORIZED FUEL TREATMENT APPARATUS OF INTERNAL COMBUSTION ENGINE

(75) Inventors: Hideyuki Oki, Wako (JP); Asao Ukai, Wako (JP); Shinichi Kitajima, Wako (JP); Hironao Fukuchi, Wako (JP); Atsushi Matsubara, Wako (JP); Teruo Wakashiro, Wako (JP); Shigetaka Kuroda, Wako (JP); Takashi Kiyomiya, Wako (JP); Atsushi Izumiura, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 23 days.

(21) Appl. No.: 09/739,250

(22) Filed: Dec. 19, 2000

(65) Prior Publication Data

US 2001/0003979 A1 Jun. 21, 2001

(30) Foreign Application Priority Data

Dec. 20, 1999 (JP) ..... 11-361925

(51) Int. Cl.[7] ..... F02M 33/02
(52) U.S. Cl. ..... 123/520; 123/516
(58) Field of Search ..... 123/520, 519, 123/518, 516, 698, 680, DIG. 11

(56) References Cited

U.S. PATENT DOCUMENTS 3,577,966 A * 5/1971 Dollingwood ..... 123/DIG. 11
3,802,403 A * 4/1974 Dewick et al. ..... 123/DIG. 11
3,974,809 A * 8/1976 Stumpp et al. ..... 123/452
4,244,334 A * 1/1981 Maisch ..... 123/325
4,367,720 A * 1/1983 Miyoshi et al. ..... 123/571
4,901,702 A * 2/1990 Beicht et al. ..... 123/520
5,373,830 A * 12/1994 Denz et al. ..... 123/520
2001/0003982 A1 * 6/2001 Oki et al. ..... 123/698

* cited by examiner

*Primary Examiner*—Gene Mancene
*Assistant Examiner*—Mahmoud Gimie
(74) *Attorney, Agent, or Firm*—Arent Fox Kintner Plotkin & Kahn

(57) ABSTRACT

In order to prevent an occurrence of dieseling phenomenon, and to prevent engine rotation speed from decreasing during idle operation or the idle operation from being stopped, in step S111, it is determined whether the flag value of an idle stop flag F_IDLSTP is "1" or not. If it is determined that the determination result is "YES", that is, if it is determined that the internal combustion engine body is stopped, 0% is set to a target purge control valve drive duty value PGCMD (step S105), and 0 is set to the target purge flow rate QPGC (step S106). If it is determined that the determination result is "NO", that is, when the internal combustion engine body is in operation, PGCMD calculation processing is executed (step S112). While the internal combustion engine body is stopped, execution of purge is stopped, thereby an occurrence of a dieseling phenomenon which is caused because the flow rate of the air flowing into the internal combustion engine body increases and the air is compressed, is prevented, thereby suppressing vibration from occurring in the internal combustion engine body.

6 Claims, 12 Drawing Sheets

VAPORIZED FUEL TREATMENT APPARATUS OF INTERNAL COMBUSTION ENGINE

BACKGROUND OF THE INVENTION

1. Field of the Invention

The present invention relates to a vaporized fuel treatment apparatus of an internal combustion engine, and more specifically, relates to technology for adjusting purge flow rate purged from a canister to an intake system depending on operating conditions of the internal combustion engine.

2. Description of the Related Art

A vaporized fuel treatment apparatus of an internal combustion engine is heretofore known, in which vaporized fuel from a fuel tank is guided to a canister and adsorbed therein, while a purge control valve in a purge path connecting the canister and the intake system is opened under predetermined operating conditions to purge purged fuel to the intake system, as in the vaporized fuel treatment apparatus of an internal combustion engine disclosed in, for example, Japanese Unexamined Patent Application, First Publication No. 11-62729.

With a vaporized fuel treatment apparatus of an internal combustion engine according to one example of the above described prior art, for example, in the idle operating condition, such as when driving a vehicle, there is a case where a control for reducing fuel consumption by stopping fuel supply to the internal combustion engine to stop the internal combustion engine and inhibit unnecessary idle operation, namely a so-called idle stop, is executed.

At the time of stopping the internal combustion engine, if air flows in via the purge path, the air is compressed, and a so-called dieseling phenomenon may occur. When this dieseling phenomenon occurs, a problem is caused in that unpleasant vibration is generated in the internal combustion engine.

Moreover, at the time of operating the internal combustion engine, a coefficient for restricting the purge flow rate is normally updated for a predetermined period of time, to gradually increase the purge flow rate. However, in the idle operating condition, for example, if the purge flow rate is increased at an updated speed similar to that while driving, there is a possibility that the internal combustion engine rotation speed may be unstable due to the influence of the vaporized fuel.

In view of the above circumstances, it is an object of the present invention to provide a vaporized fuel treatment apparatus of an internal combustion engine, which can prevent occurrence of the dieseling phenomenon and prevent the engine rotation speed from becoming unstable during idle operation.

In order to solve the above described problems and achieve the object, the vaporized fuel treatment apparatus of an internal combustion engine of the present invention according to a first aspect of the invention is characterized in that it comprises a canister (for example, a canister 45 in an embodiment described later) for adsorbing vaporized fuel generated in a fuel tank (for example, a fuel tank 41 in the embodiment described later); a purge control device (for example, ECU 5 in the embodiment described later) for controlling the opening of a purge valve (for example, a purge valve 44 in the embodiment described later) disposed in a path (for example, a purge path 43 in the embodiment described later) connecting the canister and an intake system of an engine (for example, an internal combustion engine body 1 in the embodiment described later); and a stop device (for example, ECU 5 in the embodiment described later) for stopping the internal combustion engine when a stop condition of the internal combustion engine (for example, an idle stop flag F_IDLSTP=1 in the embodiment described later) is established, wherein the purge control device closes the purge valve when the stop condition is established.

According to the vaporized fuel treatment apparatus of the internal combustion engine having the above described construction, for example, even if the operation of the internal combustion engine is stopped by means of idle stop or the like, since the purge valve is closed by the purge control device, air is prevented from flowing in, thereby enabling prevention of the occurrence of the dieseling phenomenon.

Moreover, the vaporized fuel treatment apparatus of the internal combustion engine of the present invention according to a second aspect of the invention is characterized in that it comprises a canister (for example, a canister 45 in an embodiment described later) for adsorbing vaporized fuel generated in a fuel tank (for example, a fuel tank 41 in the embodiment described later); a purge control device (for example, ECU 5 in the embodiment described later) for controlling the opening of a purge valve (for example, a purge valve 44 in the embodiment described later) disposed in a path (for example, a purge path 43 in the embodiment described later) connecting the canister and an intake system of an engine; and an idle detection device (for example, ECU 5 in the embodiment described later) for detecting whether the internal combustion engine is in the idle state or not, wherein the purge control device increases the opening of the purge valve for each predetermined period of time longer than that in the non-idle state, when the idle state is detected by the idle detection device.

According to the vaporized fuel treatment apparatus of the internal combustion engine having the above described construction, when it is determined that the internal combustion engine is in the idle state by the idle detection device, the time period for increasing the opening of the purge valve is made longer, to thereby suppress the vaporized fuel from flowing rapidly, enabling prevention of the internal combustion engine rotation speed from becoming unstable.

DESCRIPTION OF THE PREFERRED EMBODIMENT

An embodiment of the present invention will now be described with reference to drawings.

Figure 1:
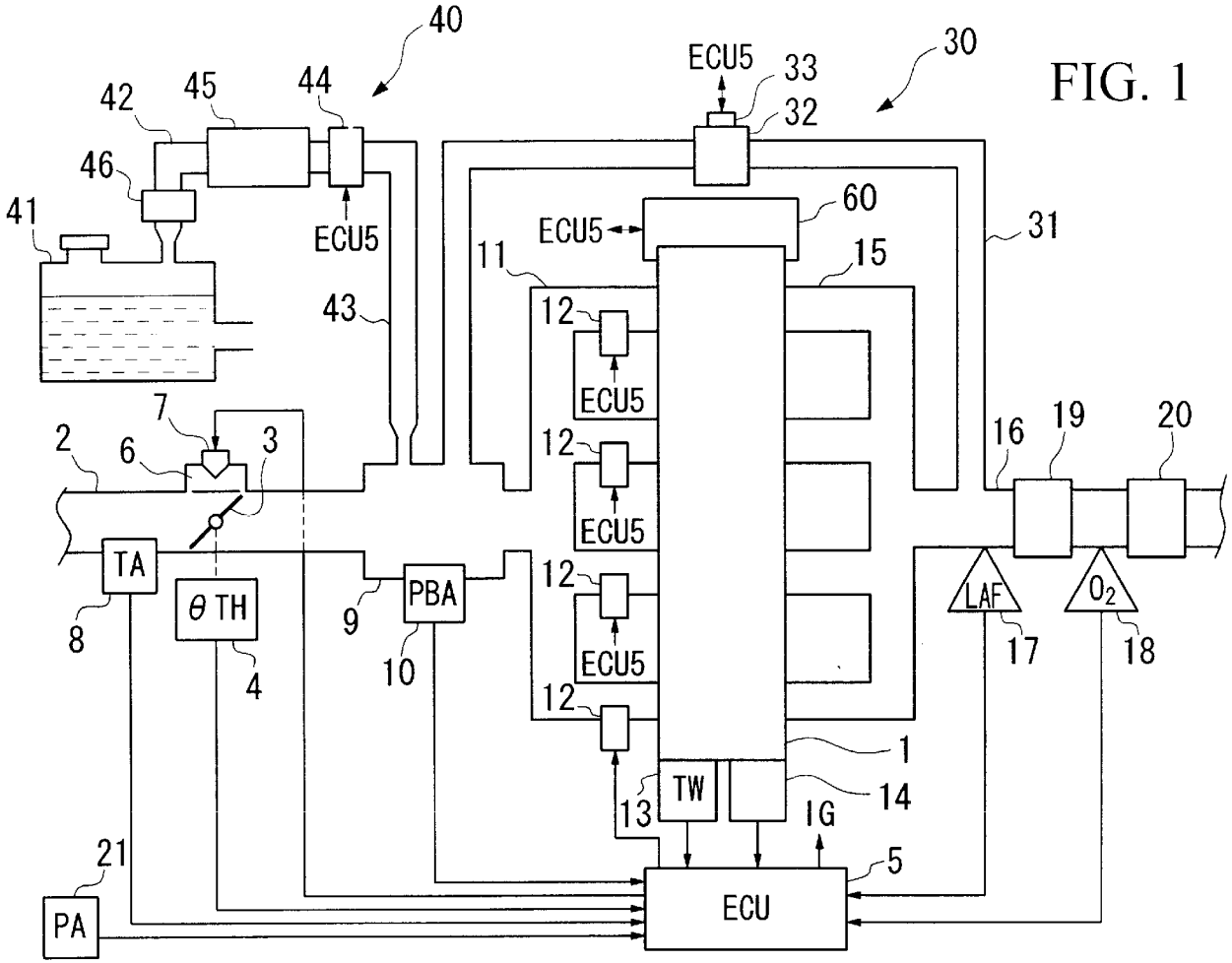
FIG. 1 is a block diagram showing a first embodiment of the present invention.

FIG. 1 is a diagram showing an embodiment of the present invention. In the figure, reference symbol 1 denotes an internal combustion engine body for generating power, being an in-line four-cylinder type engine provided with an intake valve and an exhaust valve (not shown) for each cylinder.

An intake pipe 2 connects to a combustion chamber of each cylinder in the internal combustion engine body 1 via a branch connection (intake manifold) 11. A throttle valve 3 is arranged halfway along the intake pipe 2. A throttle valve opening (θTH) sensor 4 is connected to the throttle valve 3, for outputting an electric signal depending on the degree of throttle valve opening θTH, to supply the signal to an ECU 5. An auxiliary air path 6 for bypassing the throttle valve 3 is provided in the intake pipe 2, and an auxiliary air quantity control valve 7 is arranged halfway along the path 6. The auxiliary air quantity control valve 7 is connected to the ECU 5, to thereby control the valve opening amount by means of the ECU 5.

On the upstream side of the throttle valve 3 of the intake pipe 2, an intake temperature (TA) sensor 8 is mounted, and the detection signal thereof is supplied to the ECU 5. A chamber 9 is disposed between the throttle valve 3 in the intake pipe 2 and the intake manifold 11, and an intake pipe absolute pressure (PBA) sensor 10 is fitted in the chamber 9. A detection signal of the PBA sensor 10 is supplied to the ECU 5.

An internal combustion engine water temperature (TW) sensor 13 is mounted on the internal combustion engine body 1, and a detection signal thereof is supplied to the ECU 5. A crank angle position sensor 14 for detecting a turning angle of a crank shaft (not shown) of the internal combustion engine body 1 is connected to the ECU 5, and a signal depending on the turning angle of the crank shaft is supplied to the ECU 5. The crank angle position sensor 14 consists of a cylinder determination sensor for outputting a signal pulse at a predetermined crank angle position of a specific cylinder of the internal combustion engine body 1 (hereinafter referred to as "CYL signal pulse"), a TDC sensor for outputting a TDC signal pulse at a crank angle position before a predetermined crank angle (with the four-cylinder type engine, for each 180 degrees of the crank angle), with regard to a top dead center (TDC) at the time of starting the intake stroke of each cylinder, and a CRK sensor for generating one pulse at a certain crank angle cycle (for example, 30 degree cycle) shorter than the TDC signal pulse (hereinafter referred to as "CRK signal pulse"), and the CYL signal pulse, TDC signal pulse and CRK signal pulse are supplied to the ECU 5. These signal pulses are used for various timing control of fuel injection timing, ignition timing or the like, and detection of the internal combustion engine rotation speed NE.

On a slightly upstream side of the intake valve of the intake manifold 11, a fuel injection valve 12 is provided for each cylinder, and each fuel injection valve 12 is connected to a fuel pump (not shown) as well as being electrically connected to the ECU 5, to thereby control the fuel injection timing and the fuel injection time (valve opening time) by means of a signal from the ECU 5. An ignition plug (not shown) of the internal combustion engine body 1 is also electrically connected to the ECU 5, to thereby control the ignition timing θ IG by means of the ECU 5.

An exhaust pipe 16 is connected to the combustion chamber of the internal combustion engine body 1 via a branch connection (exhaust manifold) 15. The exhaust pipe 16 of the exhaust system is provided with a large area air/fuel ratio sensor (hereinafter referred to as "LAF sensor") 17, on the directly downstream side of a portion where the branch connection 15 comes together. Moreover, on the downstream side of the LAF sensor 17, a just below three way catalyst 19 and an under floor three way catalyst 20 are arranged, and an oxygen concentration sensor (hereinafter referred to as "$O_2$ sensor") 18 is mounted between these three way catalysts 19 and 20. The three way catalysts 19 and 20 carry out purification of HC, CO, $NO_x$ or the like in the exhaust gas.

The LAF sensor 17 is connected to the ECU 5 for detecting the oxygen concentration in the exhaust gas, that is, the actual air/fuel ratio to thereby output an electric signal in proportion to the actual air/fuel ratio, and supply the electric signal to the ECU 5. The $O_2$ sensor 18 has a characteristic in that the output suddenly changes before and after the theoretical air/fuel ratio, with the output being a high level on the richer side than the theoretical air/fuel ratio, and a low level on the leaner side. The $O_2$ sensor 18 is connected to the ECU 5, and the detection signal thereof is supplied to the ECU 5.

An exhaust reflux mechanism 30 comprises an exhaust reflux path 31 for connecting the chamber 9 of the intake pipe 2 and the exhaust pipe 16, an exhaust reflux valve (EGR valve) 32 for controlling the exhaust reflux quantity, and a lift sensor 33 for detecting the degree of valve opening of the EGR valve 32 and supplying the detection signal to the ECU 5. The EGR valve 32 is a solenoid valve having a solenoid, and the solenoid is connected to the ECU 5, so that the degree of valve opening can be linearly changed by a control signal from the ECU 5.

The vaporized fuel treatment apparatus 40 is for purging vaporized fuel generated in a fuel tank 41 into the intake system of the internal combustion engine body 1. The fuel tank 41 connects to a canister 45 via a path 42, and the canister 45 connects to the chamber 9 of the intake pipe 2 via a purge path 43. The canister 45 has an adsorbent built therein which adsorbs the vaporized fuel generated in the fuel tank 41, and a fresh-air inlet. A two-way valve 46 consisting of a positive pressure valve and a negative pressure valve is arranged halfway along the path 42, and a purge control valve 44, being a duty control type solenoid valve, is provided halfway along the purge path 43. The purge control valve 44 is connected to the ECU 5, and controlled in accordance with a signal from the ECU 5.

The ECU 5 comprises an input circuit having a function of forming a waveform of input signals from the above described various sensors to modify the voltage level to a predetermined level, changing an analog signal value to a digital signal value or the like, a central processing unit (CPU), a memory circuit consisting of ROM and RAM for storing various arithmetic programs executed by the CPU, various maps described later, and arithmetic results or the like, and an output circuit for outputting a drive signal to various solenoid valves such as the fuel injection valves 12, and the purge control valve 44, and to the ignition plugs.

The ECU 5 determines various internal combustion engine operating conditions in a feedback control operating range, an open control operating range or the like, in accordance with the output of the LAF sensor and the $O_2$ sensor, based on the above described various kinds of internal combustion engine operating parameter signals, calculates the fuel injection time TOUT of the fuel injection valves 12 depending on the internal combustion engine operating conditions, and outputs a signal for driving the fuel injection valves 12 based on the arithmetic calculation results. That is to say, the ECU 5 controls the internal combustion engine having the above described internal combustion engine body 1, fuel injection valves 12, fuel tank 41 and the vaporized fuel treatment apparatus 40. Moreover, the ECU 5 corrects the fuel injection time TOUT of the fuel injection valves 12, which is a fuel quantity supplied to the internal combustion engine body 1 by means of the fuel injection valves 12, depending on the purged quantity of the vaporized fuel by means of the vaporized fuel treatment apparatus 40.

The fuel injection time TOUT of the fuel injection valves 12 (valve opening time of the fuel injection valves 12) corresponding to the fuel quantity is schematically determined based on the following expression:

$$TOUT=KTTL\times TIM\times KAF\times KCMD-KAFEVACT\times TIM\times KCMD,$$

wherein KTTL denotes a correction coefficient other than the air/fuel ratio correction coefficient, TIM denotes a basic fuel injection quantity, being a map value determined by the intake system negative pressure of the internal combustion engine and the internal combustion engine rotation speed NE, KAF denotes an air/fuel ratio feedback coefficient, being a feedback coefficient of PID control of the air/fuel ratio depending on the output of the LAF sensor 17, KCMD denotes a target air/fuel ratio coefficient based on the target air/fuel ratio, and KAFEVACT denotes a purge correction coefficient.

As is obvious from this expression, the valve opening time TOUT of the fuel injection valves 12 is obtained by subtracting a value based on the purge correction coefficient KAFEVACT, being an effect due to purge, from a value based on the basic fuel injection quantity TIM determined from the operating conditions of the internal combustion engine, the target air/fuel ratio coefficient KCMD, and the air/fuel ratio feedback coefficient KAF. That is to say, the purge correction coefficient KAFEVACT is a correction value for correcting the fuel injection time TOUT so as to exclude the effect due to purge.

The calculation processing of the purge correction coefficient KAFEVACT (KAFEVACT_CAL) will now be described with reference to a subroutine flowchart shown in FIG. 2. With this flowchart of KAFEVACT_CAL, one cycle from START to END, is executed each time the TDC signal pulse is output from the TDC sensor.

This subroutine comprises a step for setting the purge correction coefficient KAFEVACT separately for when purge is in action, and for when purge cut is in action.

At first, in step S001, it is determined whether the flag value of the feedback control execution flag F_LAFFB is set to "1" or not, that is to say, whether the air/fuel ratio feedback control is being carried out or not. If the air/fuel ratio feedback control is being carried out (when the determination result is "YES"), the flow proceeds to step S003, and if the air/fuel ratio feedback control is not being carried out (when the determination result is "NO"), the flow proceeds to step S031.

In step S003, it is determined whether the purge control valve drive duty value DOUTPG is "0%" or not, that is to say, whether the command of the purge control valve 44 becomes "0" and purge is cut or not. If the purge control valve 44 is opened (when the determination result is "NO"), that is, when the purge is in action, the flow proceeds to step S005, and if the purge control valve 44 is closed (when the determination result is "YES"), that is, when the purge cut is in action, the flow proceeds to step S031.

[Purge in Action]

In step S005, a learning value of the air/fuel ratio feedback correction coefficient KAF (hereinafter referred to as "air/fuel ratio learning value"), KREF/KREFX, is selectively processed. Specifically, a value selected based on the operating conditions of the internal combustion engine body 1 (four conditions of idle, lean-bum, stoichiometric and rich) is set to the air/fuel ratio learning value, KREF/KREFX. The air/fuel ratio learning value, KREF, is a learning value calculated and stored during purge in action, and the air/fuel ratio learning value, KREFX, is a learning value calculated and stored during purge cut in action.

In step S007, calculation of a purge concentration coefficient KAFEV based on the air/fuel ratio learning value KREF/KREFX is performed. The calculation procedure of this purge concentration coefficient KAFEV is as shown in the subroutine flowchart (KAFEV_CAL) in FIG. 3, which will be described later.

In step S009, it is determined whether the absolute value of deviation DKCMD between this time target air/fuel ratio coefficient $KCMD_n$ and the previous target air/fuel ratio coefficient $KCMD_{n-1}$ is equal to or above a predetermined threshold #DKCMEVA or not. If the determination result is "YES", that is, the target air/fuel ratio (A/F) is now shifting, the flow proceeds to step S011, and if the target air/fuel ratio (A/F) is not shifting (the determination result is "NO"), the flow proceeds to step S013.

In step S011, a predetermined timer value #TMDKCEVA (for example, 1.5 seconds) is set to a target air/fuel ratio shift delay timer TDKCEVA and the timer is started. As a result, while the target air/fuel ratio (A/F) is shifting, that is, while it is expected that the calculation error of the purge concentration coefficient KAFEV or the like will increase, the processing thereafter is not executed.

In step S013, it is determined whether the timer value of the target air/fuel ratio shift delay timer TDKCEVA is "0 second" or not. If the determination result is "NO", processing is not executed as described above, and if the determination result is "YES", the flow proceeds to step S015.

In step S015, calculation of a target purge correction coefficient KAFEVACZ is performed. The calculation procedure of this target purge correction coefficient KAFEVACZ is as shown in the subroutine flowchart (KAFEVACZ_CAL) in FIG. 4, which will be described later.

Steps S107, S019, S021, S027 and S029 are executed for stopping the calculation processing of the purge correction coefficient KAFEVACT shortly after performing purge, that is to say, while the purge control valve 44 is opened and until the vaporized fuel reaches the intake manifold 11, since there is a possibility that the influence of the vaporized fuel on the air/fuel ratio (A/F) is delayed during that time.

Figure 5:
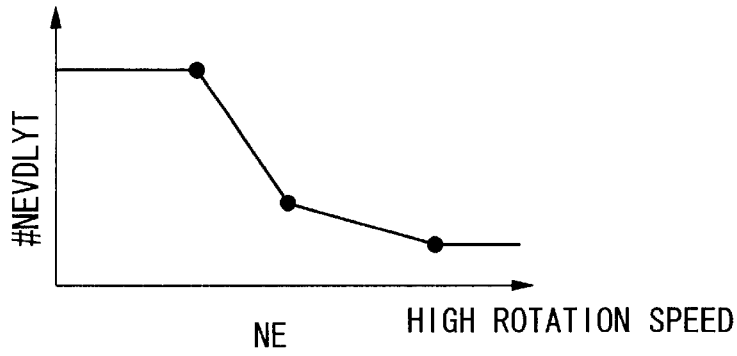
FIG. 5 is a diagram for looking up in a table a temporary variable NEVDLYT from the engine rotation speed NE.

In step S017, a predetermined value #NEVDLYT of a purge correction coefficient addition delay is set in a temporary variable NEVDLYTX. This predetermined value #NEVDLYT is obtained by table lookup of a NEVDLYT table in FIG. 5, depending on the internal combustion engine rotation speed NE. As shown in this figure, the temporary variable NEVDLYTX is set so as to become small as the internal combustion engine rotation speed NE becomes high.

In step S019, it is determined whether the counter NEVDLY is equal to or above the purge correction coefficient addition delay NEVDLYTX set in step S017 or not. If the determination result is "YES", it is judged that the above described delay due to the influence is solved, and the flow proceeds to step S021. If the determination result is "NO", it is judged that the above described delay due to the influence is not solved, and the flow proceeds to step S027.

In step S021, the flag value of flag F_NEVDLYED is set to "1" which shows that the delay is solved. As a result, even if it is determined to be "NO" in step S019, the processing returns to the processing for calculating the purge correction coefficient calculation correction coefficient KAFEVACT or the like, due to the determination in step S027.

In step S027, it is determined whether the flag value of the flag F_NEVDLYED is "1" or not, and if the determination result is "YES", the flow proceeds to step S023, and if the determination result is "NO", the flow proceeds to step S029.

In step S029, the value of the counter NEDVDLY is incremented.

In step S023, the purge correction coefficient calculation correction coefficient KEVACT is calculated. The calculation procedure of this purge correction coefficient calculation correction coefficient KEVACT is as shown in the subroutine flowchart (KEVACT_CAL) in FIG. 15 and FIG. 16, which will be described later.

In step S025, a value obtained by multiplying the target purge correction coefficient KAFEVACZ calculated in step S015 by the purge correction coefficient calculation correction coefficient KEVACT calculated in step S023 is set to the purge correction coefficient KAFEVACT.

[Purge Cut in Action]

When the air/fuel ratio feedback control is not carried out (the determination result in step S001 is "NO"), or even if the air/fuel ratio feedback control is carried out (the determination result in step S001 is "YES"), when purge cut is carried out (the determination result in step S003 is "YES"), the flow proceeds to step S031.

In step S031 and steps S033, S035 and S037, each flag value of the flag F_NEVDLYED, the counter NEVDLY, the purge correction coefficient calculation correction coefficient KEVACT, and the target purge correction coefficient KAFEVACZ are set to "0".

Moreover, in step S039, a predetermined subtraction amount #DKAFEVAM (for example, 0.023) at the time of falling of the purge correction coefficient is subtracted from the purge correction coefficient KAFEVACT, which is set to be a new purge correction coefficient KAFEVACT. As a result, even if the purge control valve 44 is fully closed (the determination result in step S003 is "YES"), it is possible to not make the purge correction coefficient KAFEVACT "0" instantly, but to gradually approximate this to "0", using the predetermined subtraction amount #DKAFEVAM at the time of falling of the purge correction coefficient. Hence, even after the purge cut, it is possible to alleviate or prevent the actual air/fuel ratio from becoming rich due to the influence of the vaporized fuel remaining in the system.

In step S041, it is determined whether the purge correction coefficient KAFEVACT after subtraction (step S011) becomes less than the target purge correction coefficient KAFEVACZ or not, and if it becomes less than that (the determination result is "YES"), the flow proceeds to step S043, and if not (the determination result is "NO"), the flow skips the step S043.

In step S043, the purge correction coefficient KAFEVACT is set to "0".

Next, the calculation procedure of the purge concentration coefficient KAFEV executed in step S007 in FIG. 2 will be described, using the subroutine flowchart in FIG. 3.

This subroutine comprises: a step for setting an addition/subtraction term DKEVAPO of the purge concentration coefficient KAFEV separately for during idle operation and for during traveling; a step for setting an addition/subtraction term DKEVAPO during traveling in accordance with the target air/fuel ratio coefficient KCMD; and a step for preventing erroneous learning of the purge concentration coefficient KAFEV during shifting of the target air/fuel ratio coefficient KCMD.

At first, in step S051, it is determined whether the flag value of the previous feedback control execution flag F_LAFFB is set to "1" or not, that is, the air/fuel ratio feeedback control has been conducted or not, and if the air/fuel ratio feedback control has not been conducted (the determination result is "NO"), the processing is terminated as is, and if the air/fuel ratio feedback control has been conducted (the determination result is "YES"), the flow proceeds to step S053.

In step S053, it is determined whether the flag value of the idle operation flag F_IDLE is set to "1" or not, that is, whether the internal combustion engine body 1 is in the idle operating condition or not. If it is in the idle operating condition (the determination result is "YES"), the flow proceeds to step S055, and if it is outside the idle operating condition (the determination result is "NO"), the flow proceeds to step S057.

In step S055, a predetermined value #DKEVAPO1 (for example, 0.001) is set to the addition/subtraction term DKEVAPO. This #DKEVAPO1 is an addition/subtraction term in the idle operating condition.

In step S057, it is determined whether the vehicle speed VP is "0" or not, that is, whether the vehicle is stopped or not. If the vehicle is stopped (the determination result is "YES"), the flow proceeds to step S055, and if the vehicle is traveling (the determination result is "NO"), the flow proceeds to step S059.

Figure 7:
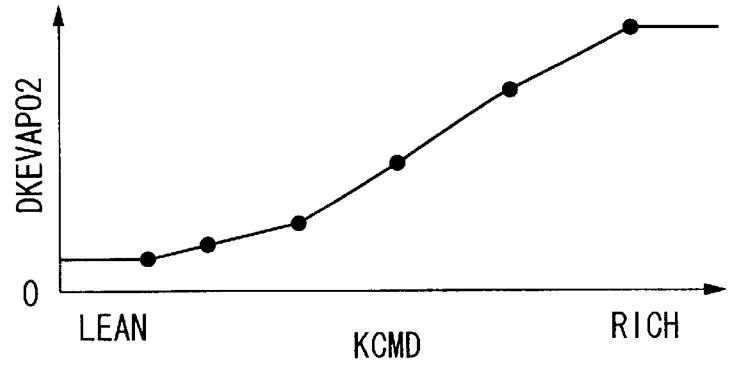
FIG. 7 is a diagram for looking up in a table an addition/subtraction term DKEVAPO2 from a target air/fuel ratio coefficient KCMD.

In step S059, an addition/subtraction term #DKEVAPO2 in accordance with the target air/fuel ratio coefficient KCMD is looked up in a table (FIG. 7). This #DKEVAPO2 is an addition/subtraction term outside the idle operating condition, and as shown in FIG. 7, it is set so that it becomes smaller as the target air/fuel ratio coefficient KCMD decreases. As a result, in the lean-burn state (the determination result is "YES") where burning becomes unstable, changes in the purge concentration coefficient KAFEV can be made gradual, thereby enabling prevention of deterioration in the operability due to over-lean.

In step S061, a predetermined value #DKEVAPO2 (for example, 0.07) obtained by the table lookup in step S059 is set to the addition/subtraction term DKEVAPO.

By the above described steps S053 to S061 however, the processing for setting the addition/subtraction term DKEVAPO of the purge concentration coefficient KAFEV separately for during idle operation and for during traveling, and the processing for setting the addition/subtraction term DKEVAPO even during traveling in accordance with the target air/fuel ratio coefficient KCMD are realized.

In step S063, it is determined whether or not an absolute value of the deviation DKCMD between the this time value $KCMD_n$ and the previous value $KCMD_{n-1}$ of the target air/fuel ratio coefficient is equal to or above a predetermined threshold #DKCMEV (for example, 0.08). If the determination result is "YES", that is, it is determined that the target air/fuel ratio coefficient KCMD is shifting, the flow proceeds to step S065, and if not (the determination result is "NO"), the flow proceeds to step S067.

In step S065, a predetermined timer value #TMDKCMEV (for example, 1.5 seconds) is set to a purge concentration coefficient calculation delay timer TDKCMEV and started, after the shift of the target air/fuel ratio has been terminated. As a result, since the calculation processing of the purge concentration coefficient KAFEV is not executed during a predetermined timer time after completion of shift of the target air/fuel ratio, erroneous learning of the purge concentration coefficient KAFEV that may occur at the time of shift of the target air/fuel ratio coefficient KCMD can be effectively prevented.

In step S067, it is determined whether the purge concentration coefficient calculation delay timer TDKCMEV after completion of shift of the air/fuel ratio is "0 second" or not. If the determination result is "NO", the processing is interrupted as described above, and if the determination result is "YES", the flow proceeds to step S069.

Figure 6:
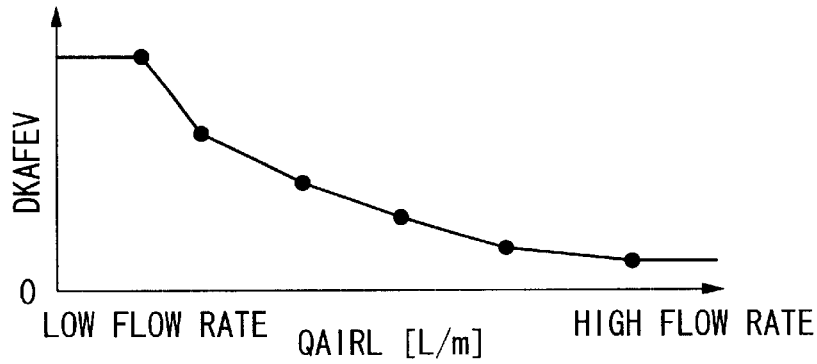
FIG. 6 is a diagram for looking up in a table a purge concentration coefficient calculation determination deviation DKAFEV from an air flow rate QAIR.

In step S069, a purge concentration coefficient calculation determination deviation DKAFEV is looked up in a table in accordance with the air flow rate QAIR (FIG. 6), and a predetermined value #DKAFEV obtained by this table lookup (for example, 0.07) is set to the purge concentration coefficient calculation determination deviation DKAFEV. The purge concentration coefficient calculation determination deviation DKAFEV is set such that it becomes smaller as the air flow rate QAIR increases, as shown in FIG. 6.

Figure 2:
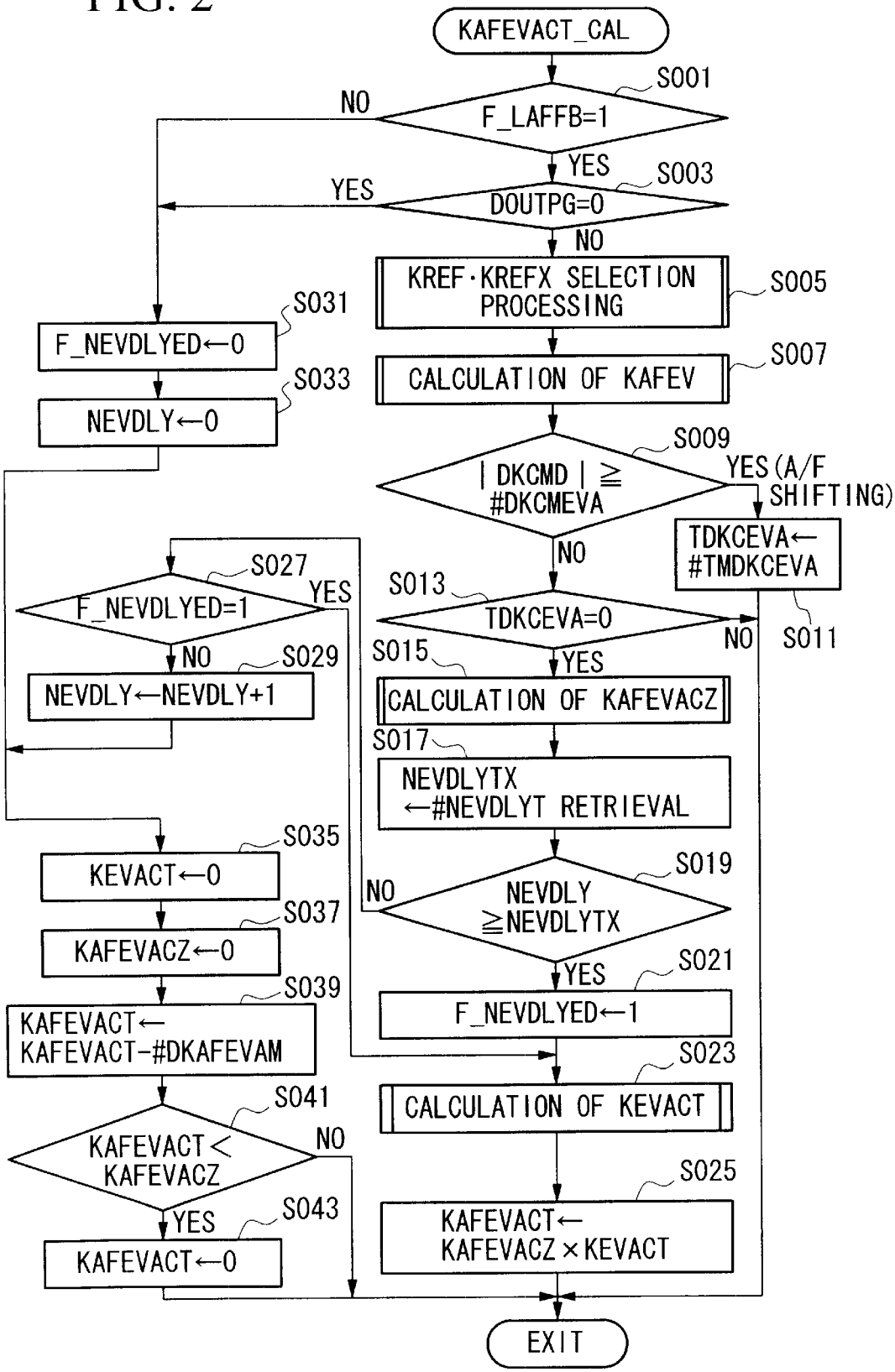
FIG. 2 is a subroutine flowchart showing a calculation procedure for a purge correction coefficient KAFEVACT.
Figure 3:
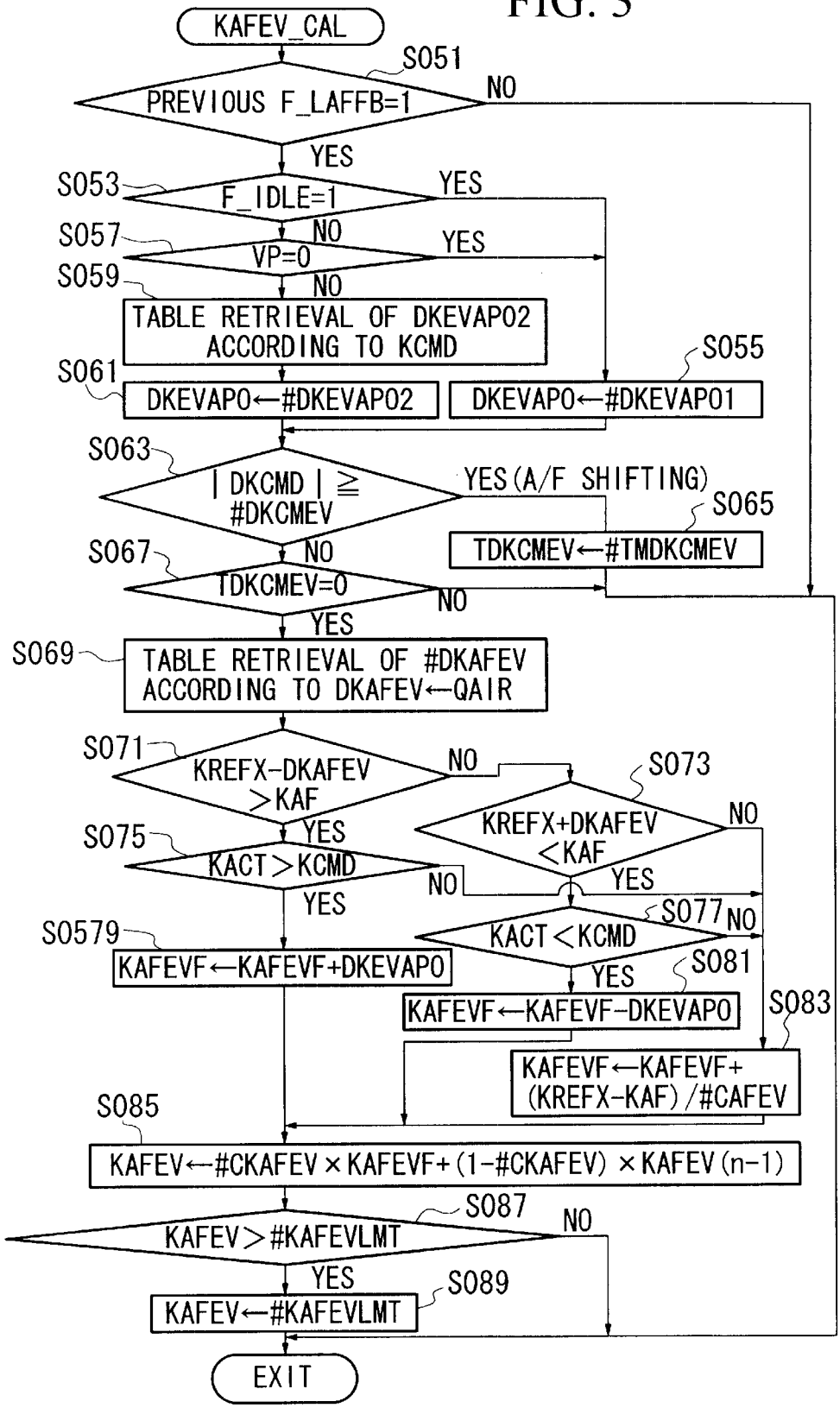
FIG. 3 is a subroutine flowchart showing a calculation procedure for a purge concentration coefficient KAFEV executed in step S007 in FIG. 2.

In steps S071 and S073, it is determined whether the air/fuel ratio feedback correction coefficient KAF obtained by using a known technique, for example, the PID control law, based on the detection value of the LAF sensor 17, is smaller than the lower threshold obtained by subtracting the purge concentration coefficient calculation determination deviation DKAFEV from the air/fuel ratio learning value KREFX selected in step S005 in FIG. 2 (the determination result in step S071 is "YES"), or is larger than the upper threshold obtained by adding the purge concentration coefficient calculation determination deviation DKAFEV thereto (the determination result in step S071 is "NO", and the determination result in step S073 is "YES" ), or is between the lower threshold and the upper threshold (the determination results in steps S071 and S073 are both "NO").

When the air/fuel ratio feedback correction coefficient KAF is smaller than the lower threshold (the determination result in step S071 is "YES"), and when the actual air/fuel ratio coefficient KACT detected by the LAF sensor 17 is larger than the target air/fuel ratio coefficient KCMD (the determination result in step S075 is "YES"), it is determined that the air/fuel ratio (A/F) becomes rich due to the influence of purge, and the flow proceeds to step S079, while if the determination result in step S075 is "NO", the flow proceeds to step S083.

When the air/fuel ratio feedback correction coefficient KAF is larger than the upper threshold (the determination result in step S071 is "NO" and the determination result in step S073 is "YES"), and when the actual air/fuel ratio coefficient KACT is smaller than the target air/fuel ratio coefficient KCMD (the determination result in step S077 is "YES"), it is determined that the influence of purge on the air/fuel ratio (A/F) is small, and the flow proceeds to step S081, while if the determination result in step S077 is "NO", the flow proceeds to step S083.

When the air/fuel ratio feedback correction coefficient KAF is between the upper and lower thresholds (the determination result in steps S071 and S073 are both "NO"), the flow proceeds to step S083.

In step S079, a value obtained by adding the addition/subtraction term DKEVAPO set in step S055 or S061 to the temporary variable KAFEVF is designated as a new temporary variable KAFEVF. As a result, the purge concentration coefficient KAFEV calculated in step S085 becomes large.

In step S081, a value obtained by subtracting the addition/subtraction term DKEVAPO from the temporary variable KAFEVF is designated as a new temporary variable KAFEVF. As a result, the purge concentration coefficient KAFEV calculated in step S085 becomes small.

In step S083, a value obtained by adding a value obtained by subtracting the air/fuel ratio feedback correction coefficient KAF from the air/fuel ratio learning value KREFX and further dividing this value by a coefficient #CAFEV (for example, 256), to the temporary variable KAFEVF is designated as a new temporary variable KAFEVF. As a result, the purge concentration coefficient KAFEV calculated in step S085 is not small nor large.

In the above described steps S071 and S073, correction with respect to the air/fuel ratio becoming rich or lean due to the influence of vaporized fuel can be properly performed, by using the air/fuel ratio learning value KREFX, as a calculation standard of the purge concentration coefficient KAFEV.

In step S085, an annealing calculation is carried out using the this time temporary variable KAFEVF the previous temporary variable KAFEVF (n−1) and an annealing value #CKAFEV (for example, 0.031), and the calculation result is set to the purge concentration coefficient KAFEV.

In step S087, it is determined whether the purge concentration coefficient KAFEV calculated in step S085 is larger than a predetermined limit value #KAFEVLMT (for example, 2.0) or not. If it exceeds this limit value #KAFEVLMT (the determination result is "YES"), the flow proceeds to step S089, and if it does not exceed the limit value #KAFEVLMT (the determination result is "NO"), the step S089 is skipped.

In step S089, the limit value #KAFEVLMT is set to the purge concentration coefficient KAFEV.

Figure 4:
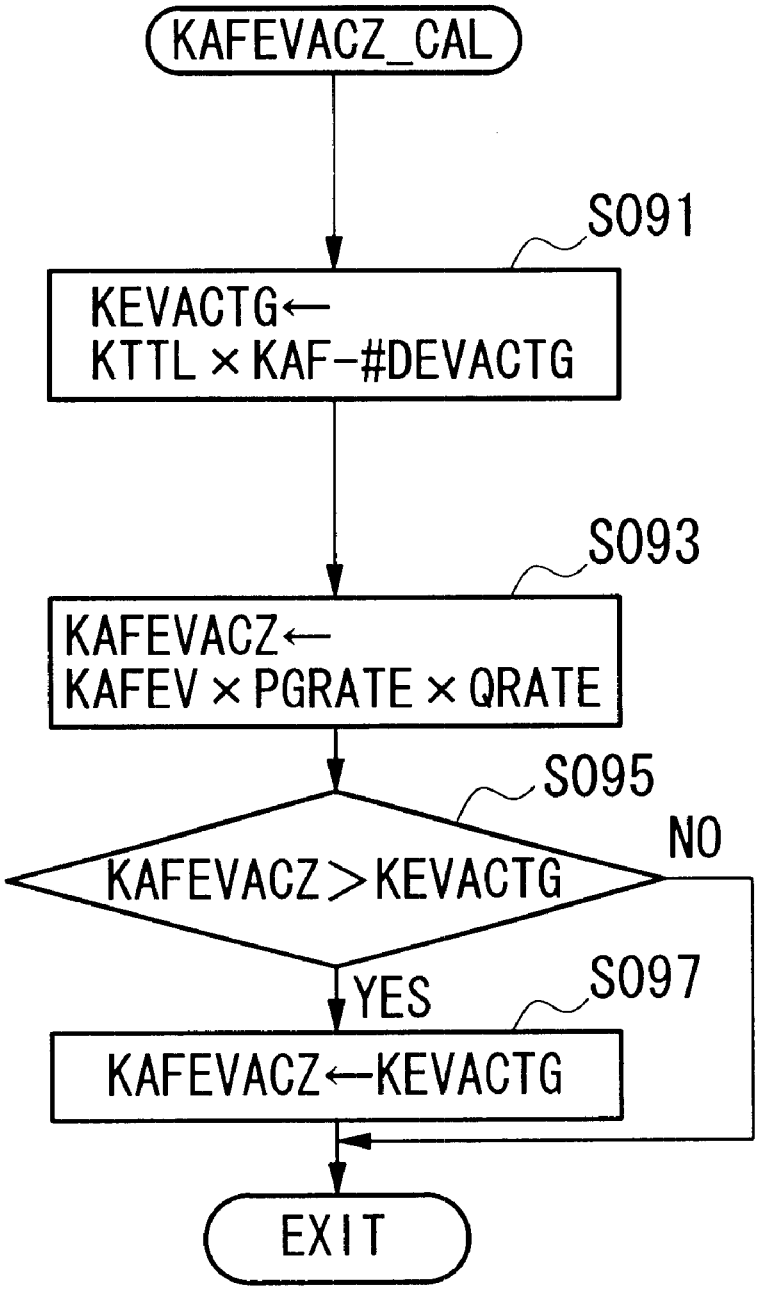
FIG. 4 is a subroutine flowchart showing a calculation procedure for a target purge correction coefficient KAFEVACZ executed in step S015 in FIG. 2.

Next, the calculation procedure of the target purge correction coefficient KAFEVACZ executed in step S015 in FIG. 2 will be described, using the subroutine flowchart in FIG. 4.

In step S091, a value obtained by multiplying the other correction coefficient KTTL by the air/fuel ratio feedback correction coefficient KAF and subtracting a predetermined guard calculation correction value #DEVACTG from that value, is set to the temporary variable KEVACTG.

In step S093, a value obtained by multiplying the purge concentration coefficient KAFEV calculated in step S023 by a purge control valve drive duty value ratio PGRATE and a target purge flow rate ratio QRATE, is set to the target purge correction coefficient KAFEVACZ.

In step S095, it is determined whether the target purge correction coefficient KAFEVACZ set in step S093 is larger than the temporary variable KEVACTG set in step S091 or not. If the determination result is "YES", the flow proceeds to step S097, and if the determination result is "NO", step S097 is skipped.

In step S097, the temporary variable KEVACTG is set to the target purge correction coefficient KAFEVACZ.

Figure 15:
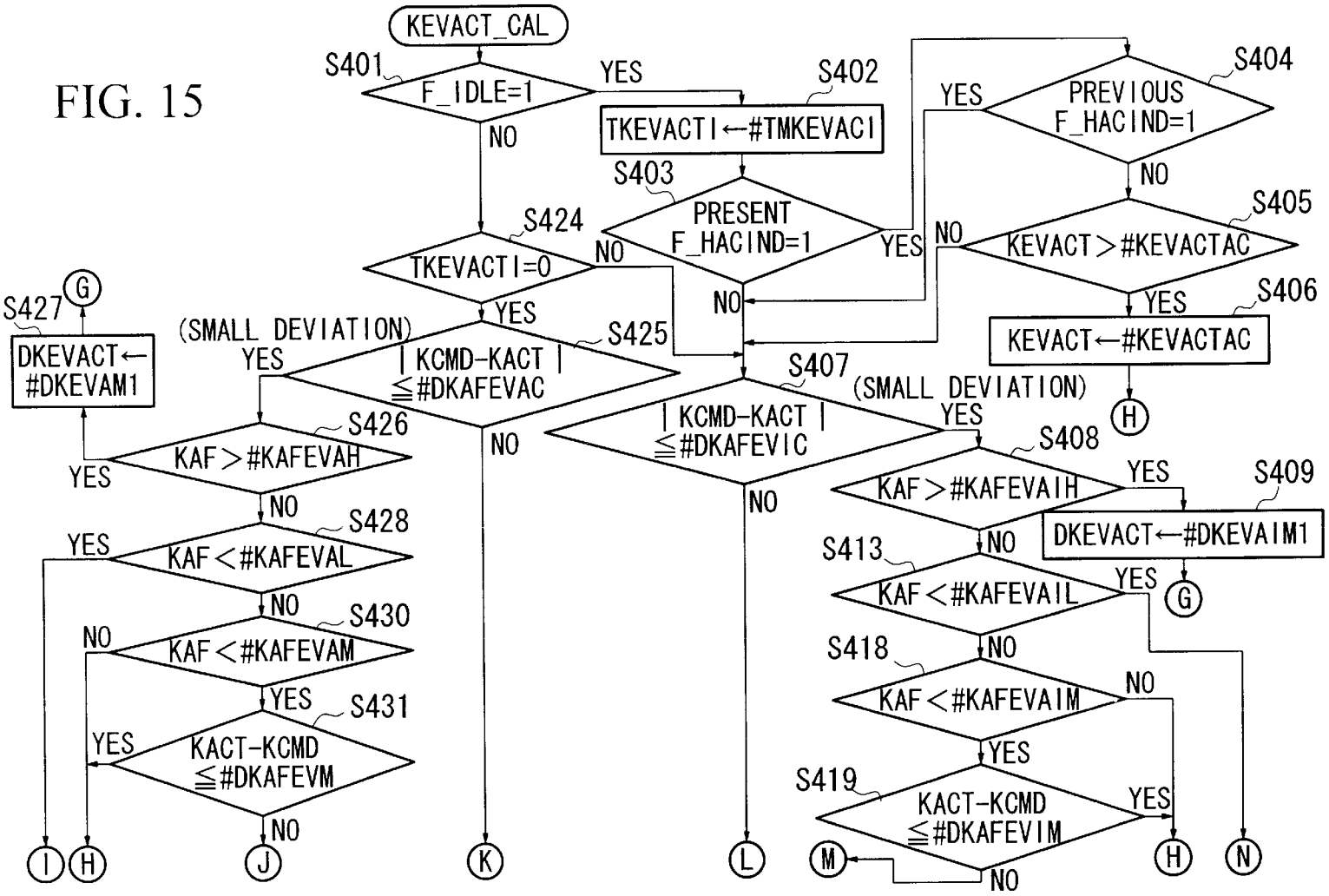
FIG. 15 is a flowchart of a part of the calculation processing for the purge correction coefficient calculation correction coefficient KEVACT, being a correction amount for correcting the purge correction coefficient KAFEVACT.
Figure 16:
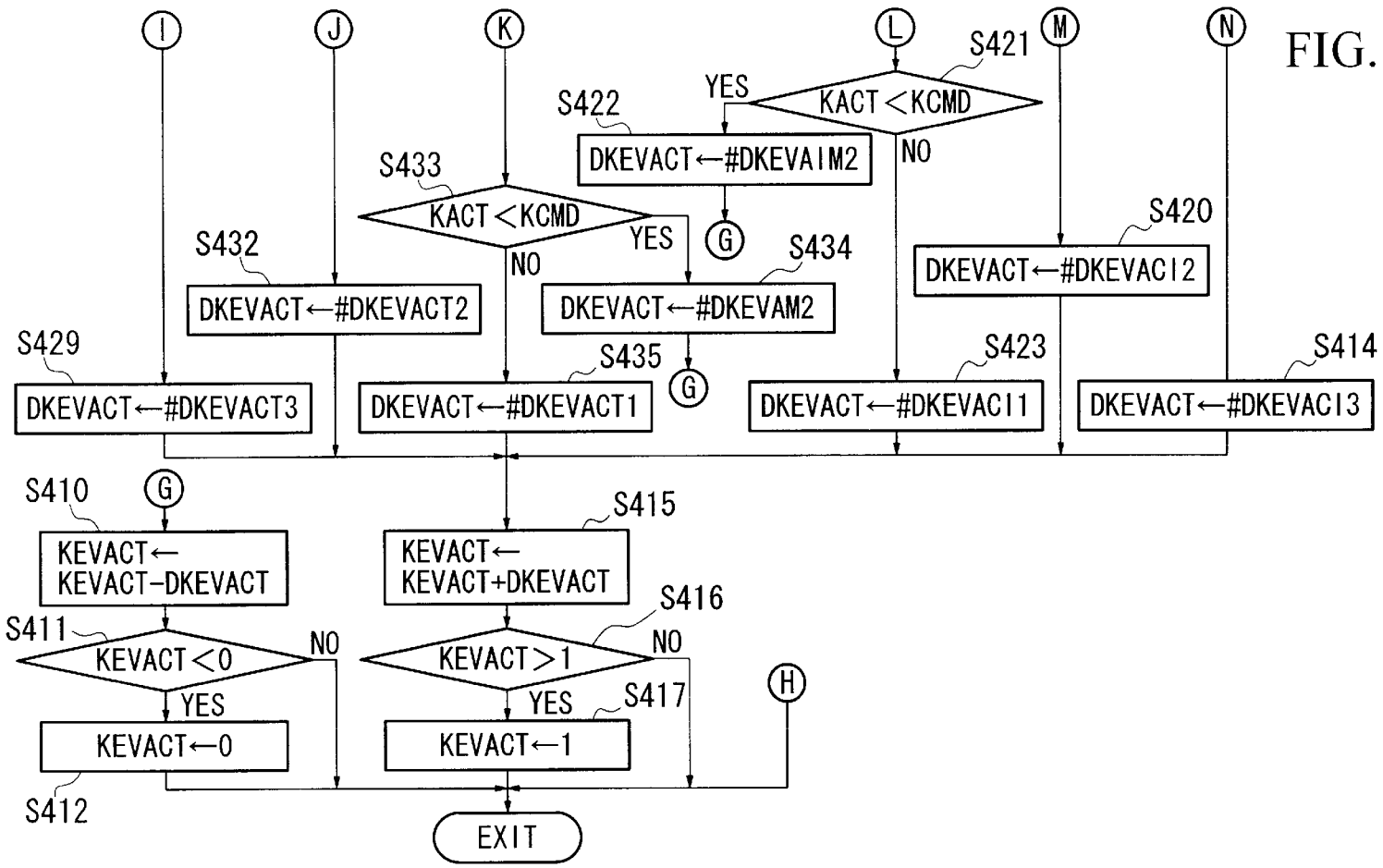
FIG. 16 is a flowchart of a part of the calculation processing for the purge correction coefficient calculation correction coefficient KEVACT, being a correction amount for correcting the purge correction coefficient KAFEVACT.

Next, the subroutine flowchart of the calculation processing (KEVACT_CAL) of the purge correction coefficient calculation correction coefficient KEVACT (equal to or below 0), being a correction for modifying the purge correction coefficient, calculated in step S023 of the flowchart in FIG. 1 will be described, with reference to FIG. 15 and FIG. 16.

At first, in step S401, it is determined whether or not the idle drive flag F_IDLE showing whether the internal combustion engine body 1 is in the idle state or not is set, that is, whether F_IDLE=1 or not.

In this step S401, if F_IDLE is not 1, that is, if the internal combustion engine body 1 is outside the idle state, the flow proceeds to step S424 described later.

[Idle State]

On the other hand, in step S401, if F_IDLE=1, that is, the internal combustion engine body 1 is in the idle state, in step S402, a timer value of an outside-idle shift delay timer TKEVACTI, which is used when it is determined whether a predetermined time has passed or not since the internal combustion engine body 1 becomes outside the idle state in step S424, is set to a predetermined outside-idle shift delay timer value #TMKEVACI (for example, 2.0s).

Next, in step S403, it is determined whether an air conditioner ON flag F_HACIND showing whether the air conditioner which becomes a load to the internal combustion engine body 1 is in the ON state or not, that is, F_HACIND=1 or not, in this cycle of the calculation processing (KEVACT_CAL) of the purge correction coefficient calculation correction coefficient KEVACT. Here, the air conditioner ON flag F_HACIND may be set by the air conditioner load itself, or may be set using the introduction of secondary air for correcting the air conditioner load as a trigger.

In this step S403, if F_HACIND is not 1, it is determined that the air conditioner is not in the ON state, and the load on the internal combustion engine body 1 is small, and the flow proceeds to step S407 described later.

On the other hand, in step S403, if F_HACIND=1, it can be determined that the air conditioner is in the ON state, and the load on the internal combustion engine body 1 is increasing. At this time, in the next step S404, it is determined whether the air conditioner ON flag F_HACIND has been set or not in the previous cycle of the calculation processing (KEVACT_CAL) of the purge correction coefficient calculation correction coefficient KEVACT, that is, if F_HACIND=1 or not.

In step S404, if F_HACIND is 1 in the previous cycle, since F_HACIND is 1 in this cycle in step S403, it is determined that the air conditioner ON state is sustained, and any change in the load on the internal combustion engine body 1 is not detected, and the flow proceeds to step S407.

On the other hand, in step S404, if F_HACIND is not 1 in the previous cycle, since F_HACIND is 1 in this cycle in step S403, it is determined that the air conditioner state has just been changed from the OFF state to the ON state, that is, a change in the load on the internal combustion engine body 1 has been detected, and it is determined whether the purge correction coefficient calculation correction coefficient KEVACT currently set is larger than a predetermined limit value #KEVACTAC (specifically, 0.3) or not.

In step S405, when KEVACT is not larger than #KEVACTAC, since the purge correction coefficient KAFEVACT based on the current purge correction coefficient calculation correction coefficient KEVACT is small, it is determined that even if there is a load change, the influence thereof is small, and the flow proceeds to step S407 described later.

On the other hand, in step S405, if KEVACT>#KEVACTAC, it is determined that the influence where there is a load change is large, and in step S406, the purge correction coefficient calculation correction coefficient KEVACT is initialized to the predetermined limit value #KEVACTAC determined in advance, and then, this cycle of the calculation processing (KEVACT_CAL) of the purge correction coefficient calculation correction coefficient KEVACT is terminated, and the flow returns to the flowchart of the calculation processing (KEVACT_CAL) of the purge correction coefficient KAFEVACT. Here, the initialization prevents such a phenomenon that, for example, when the purge correction coefficient KAFEVACT for correcting the fuel injection time TOUT is large, such as when high-concentration vaporized fuel is generated under a high temperature condition, or the like, an increase of vaporized fuel flowing in via the purge control valve 44 is delayed right after the load change, and if the purge correction coefficient KAFEVACT is directly used, it becomes over-correction, causing an over-lean state and the idling speed decreases.

In the above described step S403, if it is determined that F_HACIND is not 1 in this cycle, or in step S404, if it is determined that H_HACIND=1 in the previous cycle, or if it is determined that KEVACT is not larger than #KEVACTAC in step S405, then in step S407, a deviation |KCMD−KACT| between the actual air/fuel ratio coefficient KACT based on the output of the LAF sensor 17 and the target air/fuel ratio coefficient KCMD is calculated, and it is determined whether this deviation is equal to or below a predetermined addition amount changeover determination value #DKAFEVIC (specifically, 0.023) or not.

In step S407, if the deviation |KCMD−KACT| is not equal to or below #DKAFEVIC, that is, the deviation |KCMD−KACT| is large, the flow proceeds to step S421 described later.

On the other hand, in step S407, if the deviation |KCMD−KACT| is equal to or below #DKAFEVIC, that is, the deviation |KCMD−KACT| is small, in step S408, it is determined whether the air/fuel ratio feedback correction coefficient KAF is larger than a large predetermined subtraction determination value #KAFEVAIH (specifically, 1.063) or not.

In step S408, when KAF>#KAFEVAIH that is, if the air/fuel ratio feedback correction coefficient KAF becomes larger than #KAFEVAIH (1.063), the purge correction coefficient calculation correction coefficient KEVACT is to be decreased. Then, in step S409, an update amount DKEVACT which decreases the purge correction coefficient KAFEVACT is designated as a predetermined subtraction amount #DKEVAIM1 (specifically, 0.00005).

In step S410, the update amount DKEVACT is subtracted from the purge correction coefficient calculation correction coefficient KEVACT, and this value is set as a new purge correction coefficient calculation correction coefficient KEVACT. Subsequently, in step S411, it is determined whether this set purge correction coefficient calculation correction coefficient KEVACT is smaller than "0" or not. If KEVACT is not smaller than 0, this cycle of calculation processing (KEVACT_CAL) of the purge correction coefficient calculation correction coefficient KEVACT is terminated, and the flow returns to a flowchart for the calculation processing (KAFEVACT_CAL) of the purge correction coefficient KAFEVACT.

On the other hand, in step S411, if KEVACT<0, in step S412, the purge correction coefficient calculation correction coefficient KEVACT is determined to be 0, and this cycle of calculation processing (KEVACT_CAL) of the purge correction coefficient calculation correction coefficient KEVACT is terminated, and the flow returns to a flowchart for the calculation processing (KAFEVACT_CAL) of the purge correction coefficient KAFEVACT.

In the above described step S408, if KAF is not equal to or above #KAFEVIH, in step S413, it is determined whether the air/fuel ratio feedback correction coefficient KAF is smaller than a small predetermined addition changeover determination value #KAFEVAIL (specifically, 0.953) or not.

In step S413, if KAF<#KAFEVAIH, that is, the air/fuel ratio feedback correction coefficient KAF is below #KAFEVAIH (specifically, 0.953), the purge correction coefficient calculation correction coefficient KEVACT is to be increased. Next, in step S414, the update amount DKEVACT is designated as a predetermined addition amount #DKEVACI3 (specifically, 0.0005).

Then, in step S415, the purge correction coefficient calculation correction coefficient KEVACT is added with the update amount DKEVACT, and this value is set as a new purge correction coefficient calculation correction coefficient KEVACT. Subsequently, in step S416, it is determined whether the set purge correction coefficient calculation correction coefficient KEVACT is larger than "1" or not. If KEVACT is not larger than 1, this cycle of the calculation processing (KEVACT_CAL) of the purge correction coefficient calculation correction coefficient KEVACT is terminated, and the flow returns to a flowchart for the calculation processing (KAFEVACT_CAL) of the purge correction coefficient KAFEVACT.

On the other hand, in step S416, if KEVACT>1, in step S417, the purge correction coefficient calculation correction coefficient KEVACT is made "1", and this cycle of the calculation processing (KEVACT_CAL) of the purge correction coefficient calculation correction coefficient KEVACT is terminated, and the flow returns to a flowchart for the calculation processing (KAFEVACT_CAL) of the purge correction coefficient KAFEVACT.

In the above described step S413, if KAF is not below #KAFEVAIL, in step S418, it is determined whether or not the air/fuel ratio feedback correction coefficient KAF is smaller than a predetermined maintenance determination value #KAFEVAIM (specifically, 0.992), which is slightly larger than the above described addition changeover determination value #KAFEVAIL.

In step S418, if KAF is not below #KAFEVAIM, this cycle of the calculation processing (KEVACT_CAL) of the purge correction coefficient calculation correction coefficient KEVACT is terminated without changing the purge correction coefficient calculation correction coefficient KEVACT, and the flow returns to a flowchart for the calculation processing (KAFEVACT_CAL) of the purge correction coefficient KAFEVACT.

On the other hand, in step S418, if KAF<#KAFEVAIM, that is the air/fuel ratio feedback correction coefficient KAF becomes below #KAFEVAIM (0.992), in step S419, it is determined whether a value obtained by subtracting the target air/fuel ratio coefficient KCMD from the actual air/fuel ratio coefficient KACT is equal to or below a predetermined maintenance determination value #DKAFEVIM (specifically, 0.003) or not. If KACT−DCMD≦#DKAFEVIM, that is, if the air/fuel ratio is on the lean side, this cycle of the calculation processing (KEVACT_CAL) of the purge correction coefficient calculation correction coefficient KEVACT is terminated, and the flow returns to a flowchart for the calculation processing (KAFEVACT_CAL) of the purge correction coefficient KAFEVACT.

On the contrary, in step S419, if KACT−DCMD is not equal to or below #DKAFEVIM, that is, if the air/fuel ratio is on the rich side, in step S420, the update amount DKEVACT for increasing the purge correction coefficient calculation correction coefficient KEVACT is to be set to #DKEVACT2. After performing addition processing in the above described steps S415 to S417, this cycle for the calculation processing (KEVACT_CAL) of the purge correction coefficient calculation correction coefficient KEVACT is terminated, and the flow returns to a flowchart for the calculation processing (KAFEVACT_CAL) of the purge correction coefficient KAFEVACT.

That is to say, the processing in the above described steps S408 to S420 selects the update amount DKEVACT of the purge correction coefficient calculation correction coefficient KEVACT for modifying the purge correction coefficient KAFEVACT, depending on the size of the air/fuel ratio feedback correction coefficient KAF, when the deviation |KCMD−KACT| is small. More specifically, when the air/fuel ratio feedback correction coefficient KAF is larger than a subtraction determination value #KAFEVAIH (specifically, 1.063) exceeding a central value (specifically, 1), a subtraction amount #DKEVAIM1 (specifically, 0.0005) is selected and set as the update amount DKEVACT. In the range below the subtraction determination value #KAFEVAIH (specifically, 1.063) and above the maintenance determination value #KAFEVAIM (specifically, 0.992), which are upper and lower values from the central value, the purge correction coefficient calculation correction coefficient KEVACT is not changed, and in the range smaller than the maintenance determination value #KAFEVAIM (specifically, 0.992) below that range and above the addition changeover determination value #KAFEVAIL (specifically, 0.953), and when the deviation |KCMD−KACT| is large, a small addition amount #DKEVACI2 (specifically, 0.0001) is selected and set as the update amount DKEVACT, and when it is smaller than the addition changeover determination value #KAFEVAIL (specifically, 0.953) largely falling below the central value (specifically, 1), a large addition amount #DKEVACI3 (specifically, 0.0005) is selected and set as the update amount DKEVACT.

In the above described step S407, if the deviation |KCMD−KACT| is not equal to or below #DKAFEVIC, that is, when the deviation |KCMD−KACT| is large, in step S421, it is determined whether the actual air/fuel ratio coefficient KACT is smaller than the target air/fuel ratio coefficient KCMD or not, that is, if the actual air/fuel ratio is leaner or richer than the target air/fuel ratio.

In step S421, when KACT<KCMD, that is, when the actual air/fuel ratio is leaner than the target air/fuel ratio, in step S422, the subtraction processing in the above described steps S410 to S412 is performed, by using the large predetermined subtraction amount #DKEVAIM2 (specifically, 0.0005) as the update amount DKEVACT for updating the purge correction coefficient calculation correction coefficient KEVACT, to thereby terminate this cycle of the calculation processing (KEVACT_CAL) for the purge correction coefficient calculation correction coefficient KEVACT, and the flow returns to a flowchart for the calculation processing (KAFEVACT_CAL) of the purge correction coefficient KAFEVACT.

On the other hand, in step S421, when KACT is not below KCMD, that is, when the actual air/fuel ratio is richer than the target air/fuel ratio, in step S423, the addition processing in the above described steps S415 to S417 is performed, by using the predetermined addition amount #DKEVACI1 (specifically, 0.001) as the update amount DKEVACT for updating the purge correction coefficient calculation correction coefficient KEVACT, to thereby terminate this cycle of the calculation processing (KEVACT_CAL) for the purge correction coefficient calculation correction coefficient KEVACT, and the flow returns to a flowchart of the calculation processing (KAFEVACT_CAL) for the purge correction coefficient KAFEVACT.

Here, the magnitude correlation of the above described numerical value is summarized as follows: #KAFEVAIH>#KAFEVAIM>#KAFEVAIL, and #DKEVAIM1<#DKEVAIM2, and #DKEVACI2<#DKEVACI3<#DKEVACI1.

[Outside Idle State]

In step S401, if F_IDLE is not 1, that is, when the internal combustion engine body 1 is not in the idle state, in step S424 it is determined whether a predetermined period of time has passed or not since the internal combustion engine body 1 becomes outside the idle state, depending on whether a timer value of the outside-idle shift delay timer TKEVACTI (specifically 2 seconds) is "0" or not. This is performed for eliminating the influence of the air/fuel ratio due to the abrupt change of the purge correction coefficient calculation correction coefficient KEVACT, by performing a similar processing to in the idle state, just after changeover from the idle state to outside the idle state.

In this step S424, if TKEVACT 1 is not 0, that is, when a predetermined outside-idle shift delay time has not passed after changeover from the idle state to outside the idle state, the flow proceeds to step S407 described above.

On the other hand, in this step S424, if TKEVACT1 is 0, that is, when the predetermined outside-idle shift delay time has passed after changeover from the idle state to outside the idle state, processing in which the determination value and the update value are different is performed, as in the above-described steps S407 to S423. That is to say, in step S425, the deviation |KCMD−KACT| between the actual air/fuel ratio KACT based on the output of the LAF sensor 17 and the target air/fuel ratio KCMD is calculated, and it is determined whether this deviation is equal to or below the predetermined addition amount changeover determination value #DKAFEVAC (specifically, 0.02) or not. That is to say, the calculation processing of the purge correction coefficient calculation correction coefficient KEVACT is changed depending on whether the deviation |KCMD−KACT| is large or small.

In step S425, if the deviation |KCMD−KACT| is not equal to or below #DKAFEVAC, that is, when the deviation |KCMD−KACT| is large, the flow proceeds to step S433 described later.

On the other hand, in step S425, if the deviation |KCMD−KACT| is equal to or below #DKAFEVAC, that is, when the deviation |KCMD−KACT| is small, in step S426, it is determined whether the air/fuel ratio feedback correction coefficient KAF is larger or not than a large predetermined subtraction determination value #KAFEVAH (specifically, 1.078).

In step S425, if KAF>#KAFEVAH, that is, if the air/fuel ratio feedback correction coefficient KAF is higher than #KAFEVAH which exceeds the central value, the purge correction coefficient calculation correction coefficient KEVACT is to be decreased.

In step S427, this cycle for the calculation processing (KEVACT_) of the purge correction coefficient calculation correction coefficient KEVACT is terminated, by using the predetermined subtraction amount #DKEVAM1 (specifically, 0.0005) as the update amount DKEVACT for updating the purge correction coefficient calculation correction coefficient KEVACT, and the flow returns to a flowchart of the calculation processing (KAFEVACT_CAL) for the purge correction coefficient KAFEVACT.

On the other hand, in the above described step S426, if KAF is not larger than #KAFEVAH, in step S428, it is determined whether or not the air/fuel ratio feedback correction coefficient KAF is smaller than the predetermined addition changeover determination value #KAFEVAL (specifically, 0.953).

In step S428, if KAF<#KAFEVAL, that is, if the air/fuel ratio feedback correction coefficient KAF is below #KAFEVAL, the purge correction coefficient calculation correction coefficient KEVACT is to be increased.

In step S429, the update amount DKEVACT is made the predetermined addition amount #DKEVACT3 (specifically, 0.002).

Then, the addition processing in steps S415 to S417 is performed to thereby terminate this cycle of the calculation processing (KEVACT_CAL) for the purge correction coefficient calculation correction coefficient KEVACT, and the flow returns to a flowchart of the calculation processing (KAFEVACT_CAL) for the purge correction coefficient KAFEVACT.

In the above described step S428, if KAF is not below #KAFEVAL, in step S430, it is determined whether or not the air/fuel ratio feedback correction coefficient KAF is slightly larger than the above described addition changeover determination value #KAFEVAL and smaller than the predetermined maintenance determination value #KAFEVAM (specifically, 0.992).

In step S430, if KAF is not below #KAFEVAM, this cycle of the calculation processing (KEVACT_) for the purge correction coefficient calculation correction coefficient KEVACT is terminated without changing the purge correction coefficient calculation correction coefficient KEVACT, and the flow returns to a flowchart of the calculation processing (KAFEVACT_CAL) for the purge correction coefficient KAFEVACT.

On the other hand, in step S430, if KAF<#KAFEVAM, that is, if the air/fuel ratio feedback correction coefficient KAF decreases, in step S431, it is determined whether a value obtained by subtracting the target air/fuel ratio coefficient KCMD from the actual air/fuel ratio coefficient KACT is equal to or below a predetermined maintenance determination value #DKAFEVM (specifically, 0.003) or not. If KACT−KCMD≦#DKAFEVM, that is, the air/fuel ratio is on the lean side, this cycle of the calculation processing (KEVACT_) for the purge correction coefficient calculation correction coefficient KEVACT is terminated, and the flow returns to a flowchart for the calculation processing (KAFEVACT_CAL) of the purge correction coefficient KAFEVACT.

On the contrary, in step S431, if KACT−KCMD is not equal to or below #DKAFEVM, that is, the air/fuel ratio is on the rich side, in step S432 the update amount DKEVACT for increasing the purge correction coefficient calculation correction coefficient KEVACT is to be set.

The addition processing in the above-described steps S415 to S417 is performed to thereby terminate this cycle of the calculation processing (KEVACT_CAL) for the purge correction coefficient calculation correction coefficient KEVACT, and the flow returns to a flowchart of the calculation processing (KAFEVACT_CAL) for the purge correction coefficient KAFEVACT.

That is to say, the processing in the above described steps S426 to S432 is to select the update value DKEVACT of the purge correction coefficient calculation correction coefficient KEVACT for modifying the purge correction coefficient KAFEVACT, depending on the size of the air/fuel ratio feedback correction coefficient KAF, when the deviation |KCMD−KACT| is small. Specifically, when the air/fuel ratio feedback correction coefficient KAF is larger than the subtraction determination value #KAFEVAH, the subtraction amount #DKEVAM1 (specifically, 0,0005) is selected and set as the update amount DKEVACT, and in the range of below the subtraction determination value #KAFEVAH and above the maintenance determination value #KAFEVAM, the purge correction coefficient calculation correction coefficient KEVACT is not changed, and in the range of smaller than the maintenance determination value #KAFEVAM below that range and above the addition changeover determination value #KAFEVAL, small addition amount #DKEVACT2 (specifically, 0.001) is selected and set as the update amount DKEVACT depending on the conditions. When the air/fuel ratio feedback correction coefficient KAF is smaller than the addition changeover determination value #KAFEVAL, a large addition amount #DKEVACT3 (specifically, 0.002) is selected and set as the update amount DKEVACT.

In the above described step S425, if the deviation |KCMD−KACT| is not equal to or below #DKAFEVAC, that is, if the deviation |KCMD−KACT| is large, in step S433, it is determined whether the actual air/fuel ratio coefficient KACT is smaller than the target air/fuel ratio coefficient KCMD or not, that is, the actual air/fuel ratio is leaner or richer than the target air/fuel ratio.

In step S433, if KACT<KCMD, that is, if the actual air/fuel ratio is leaner than the target air/fuel ratio, in step S434, the subtraction processing in the above described steps S410 to S412 is performed, using a large predetermined subtraction amount #DKEVAM2 (specifically, 0.001) as the update amount DKEVACT for updating the purge correction coefficient calculation correction coefficient KEVACT, to thereby terminate this cycle of the calculation processing (KEVACT_CAL) for the purge correction coefficient calculation correction coefficient KEVACT, and the flow returns to a flowchart of the calculation processing (KAFEVACT_CAL) for the purge correction coefficient KAFEVACT.

On the other hand, in step S433, if KACT is not smaller than KCMD, that is, if the actual air/fuel ratio is richer than the target air/fuel ratio, in step S435, the addition processing in the above described steps S415 to S417 is performed, using a considerably large predetermined addition amount #DKEVACT1 (specifically, 0.003) as the update amount DKEVACT for updating the purge correction coefficient calculation correction coefficient KEVACT, to thereby terminate this cycle of the calculation processing (KEVACT_CAL) for the purge correction coefficient calculation correction coefficient KEVACT, and the flow returns to a flowchart of the calculation processing (KAFEVACT_CAL) for the purge correction coefficient KAFEVACT.

Here, the magnitude correlation of the above described numerical value is summarized as follows: #KAFEVAH>#KAFEVAM>#KAFEVAL, and #DKEVAM1<#DKEVAM2, and #DKEVACT2<#DKEVACT3<#DKEVACT1.

Moreover, #DKEVAM1>#DKEVAIM1, #DKEVAM2>#DKEVAIM2, #DKEVACT1>#DKEVACI1, #DKEVACT2>#DKEVACI2, AND #DKEVACT3>#DKEVACI3.

Figure 8:
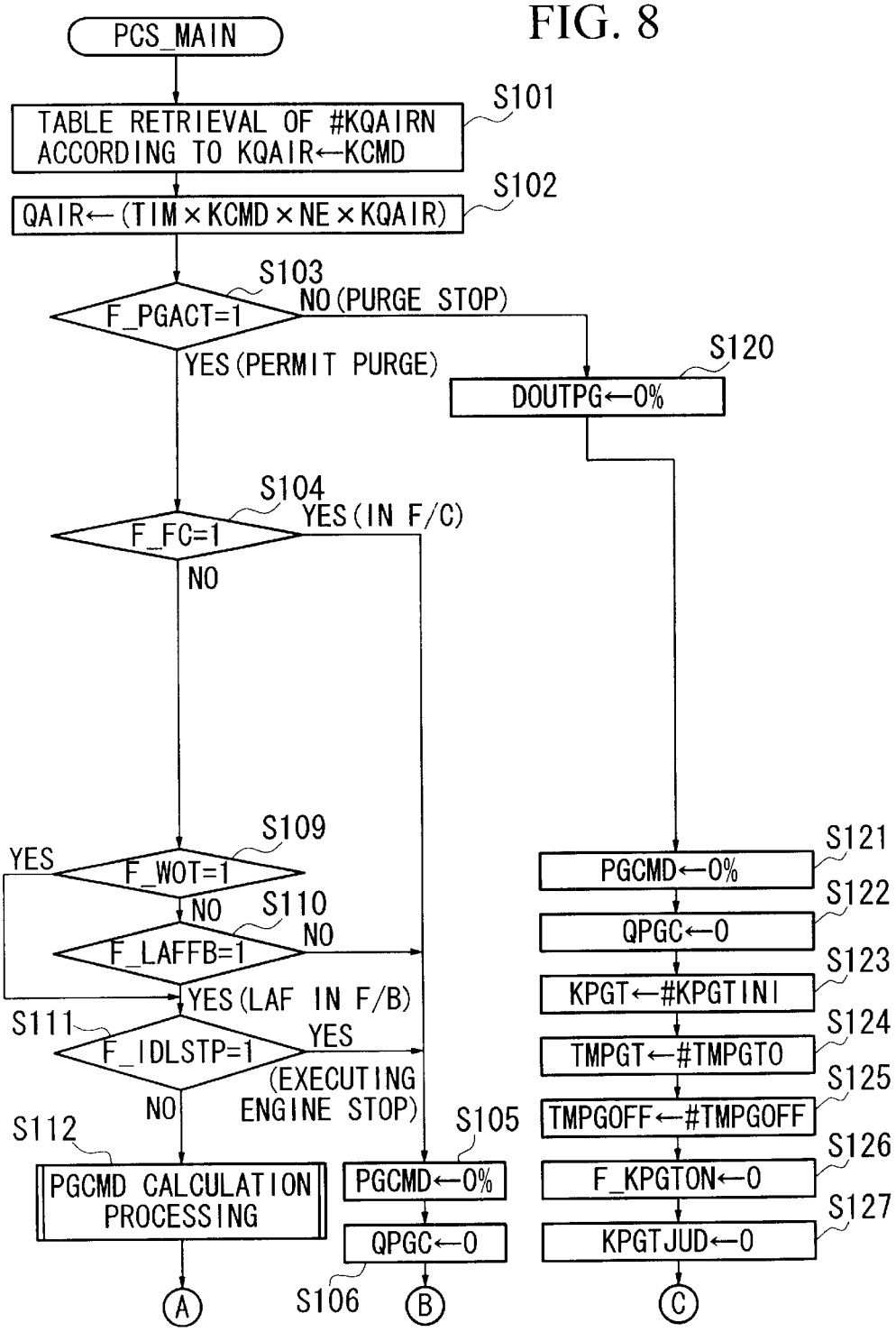
FIG. 8 is a flowchart showing a processing for drive controlling a purge control valve for making the purge flow rate be a predetermined flow rate.
Figure 9:
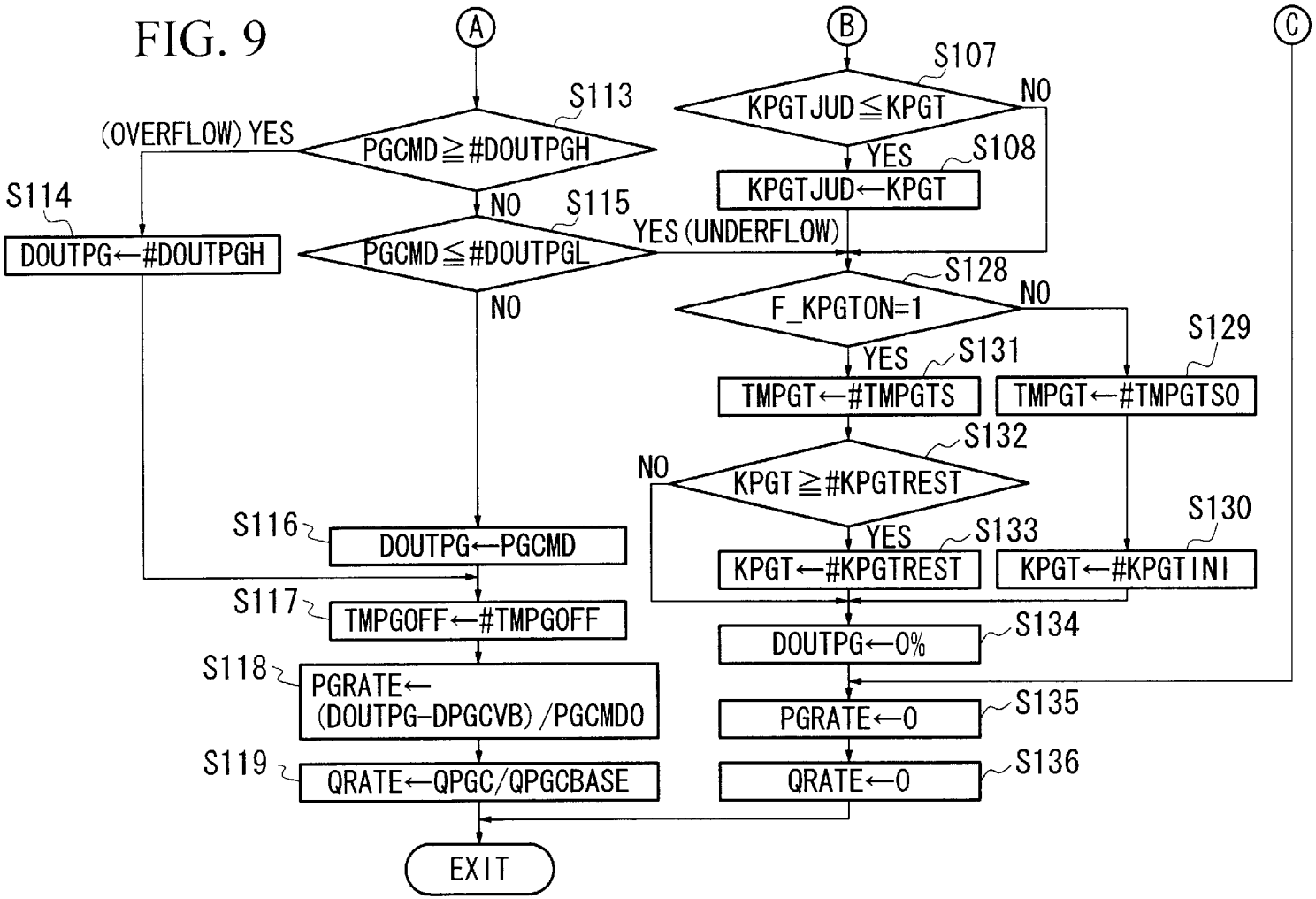
FIG. 9 is a flowchart showing a processing for drive controlling a purge control valve for making the purge flow rate be a predetermined flow rate.
Figure 10:
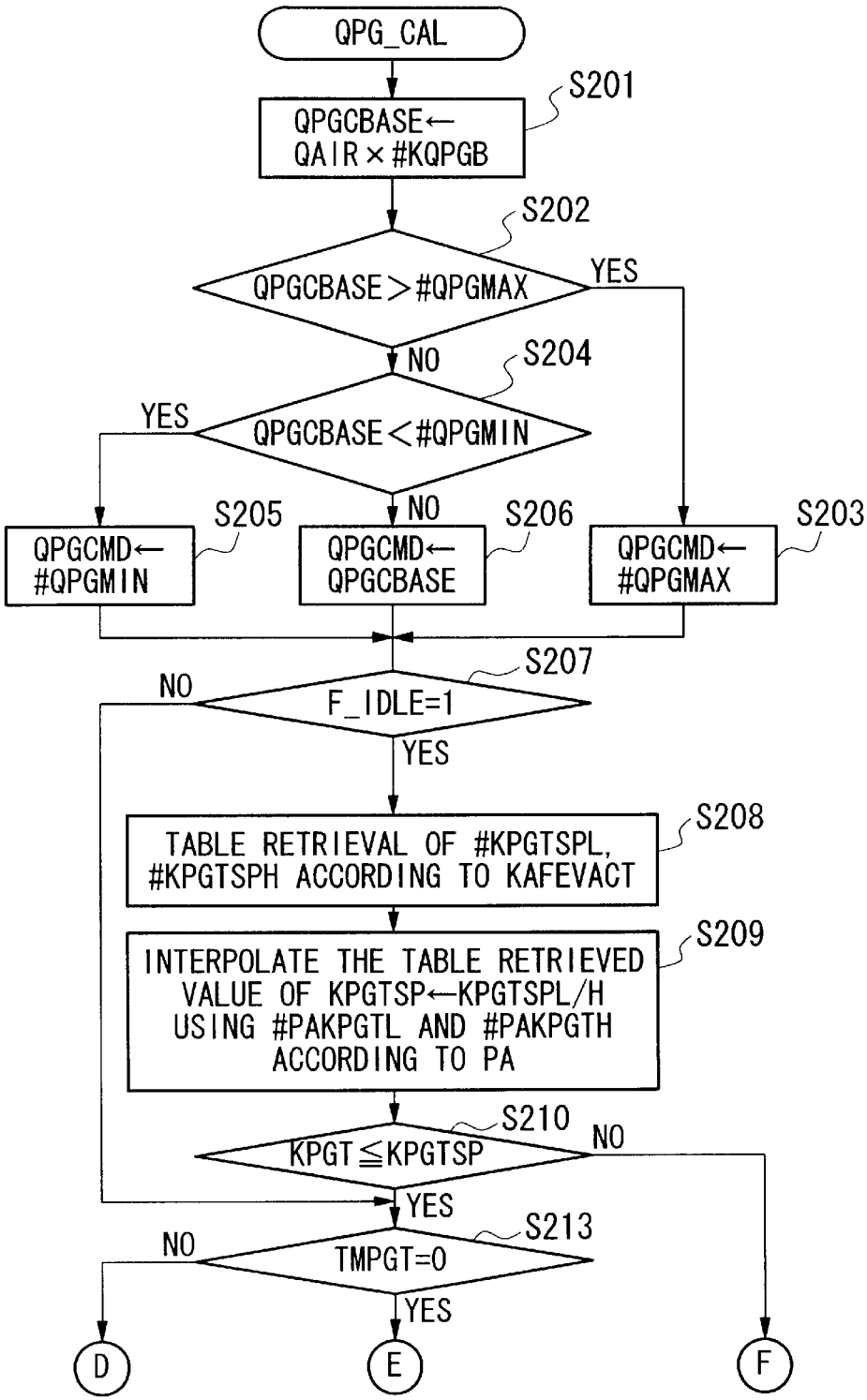
FIG. 10 is a flowchart showing a processing, in particular, for calculating a target flow rate (QPG_CAL), in the PGCMD calculation processing shown in FIG. 8.
Figure 11:
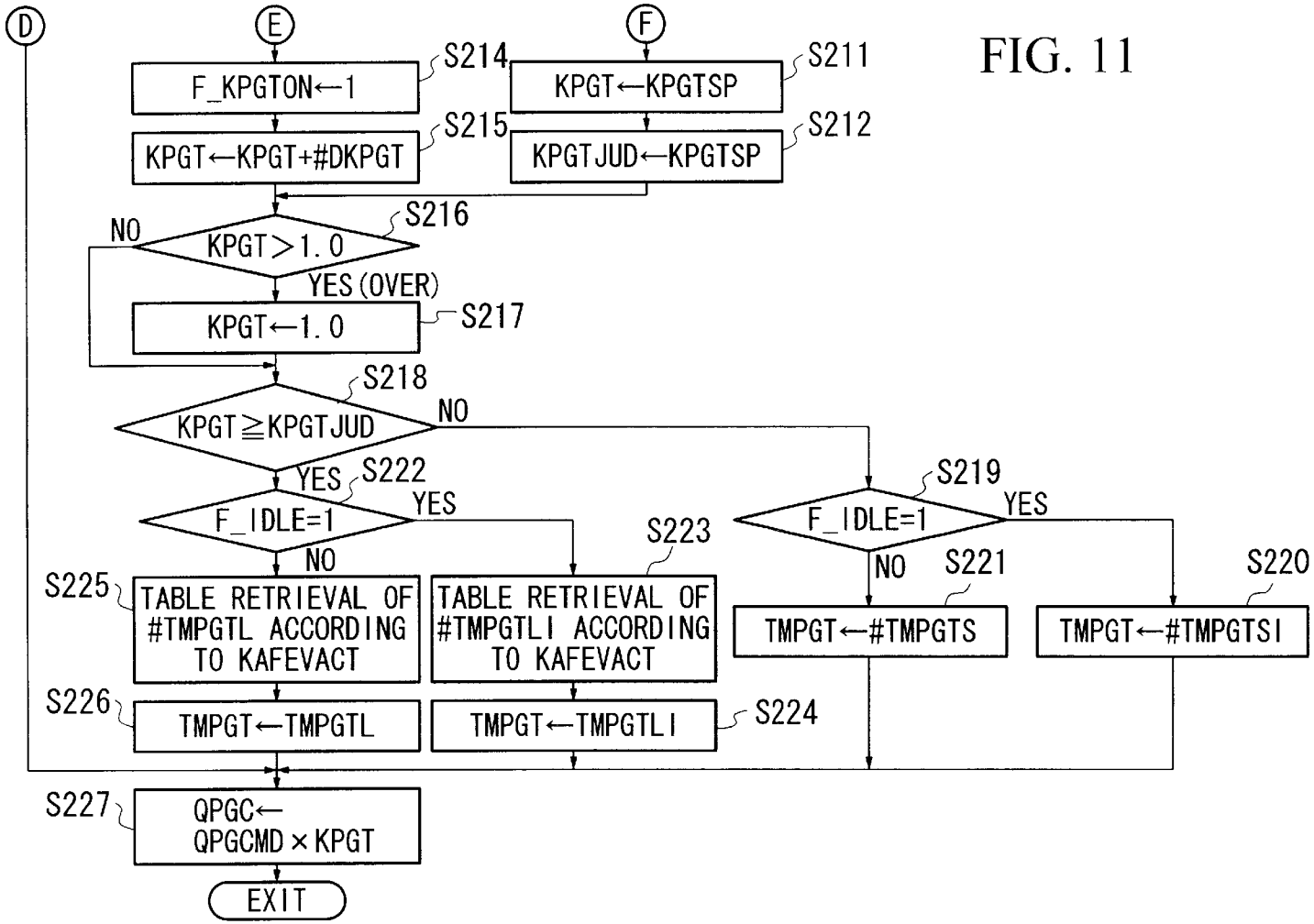
FIG. 11 is a flowchart showing a processing, in particular, for calculating a target flow rate (QPG_CAL), in the PGCMD calculation processing shown in FIG. 8.
Figure 12:
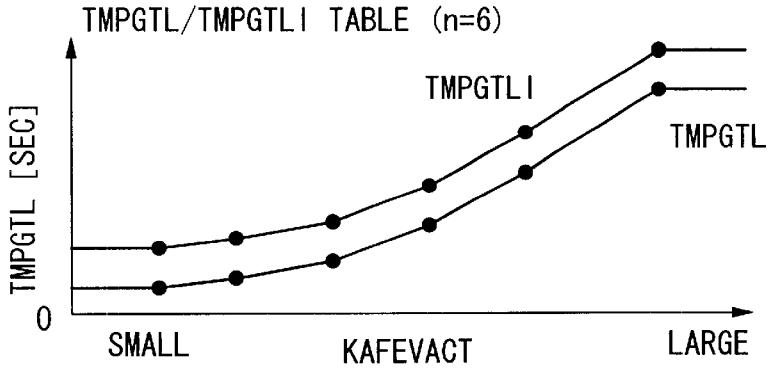
FIG. 12 is a graph of an update timer value TMPGTL/LI which varies depending on the purge correction coefficient KAFEVACT.
Figure 13:
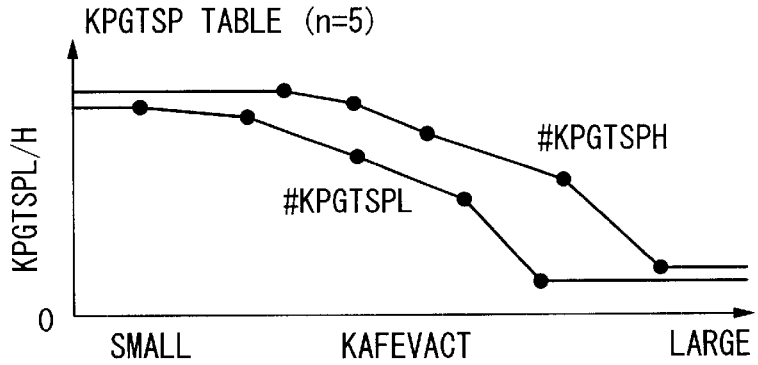
FIG. 13 is a graph of purge restricting coefficients KPGTSPL/H on the lowland side and high altitude side which vary in accordance with the purge correction coefficient KAFEVACT.
Figure 14:
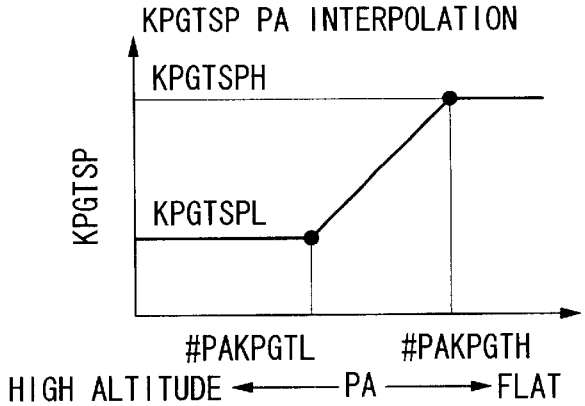
FIG. 14 is a graph of purge restricting coefficient KPGTSP which varies in accordance with the atmospheric pressure PA.

FIG. 8 and FIG. 9 are flowcharts showing processing for driving and controlling the purge control valve 44, in order to make the purge flow rate a predetermined flow rate. FIG. 10 and FIG. 11 are flowcharts showing processing, particularly, for calculation of the target flow rate (QPG_CAL), in the PGCMD calculation processing shown in FIG. 8. FIG. 12 is a graph of purge restriction coefficient KPGTSPL/H on the lowland side and high altitude side which varies in accordance with the purge correction coefficient KAFEVACT, FIG. 13 is a graph of purge restriction coefficient KPGTSP which varies in accordance with the atmospheric pressure PA, and FIG. 14 is a graph of update timer value TMPGTL/LI which varies in accordance with the purge correction coefficient KAFEVACT.

At first, in step S101 shown in FIG. 8, an air flow rate conversion factor KQAIR which is set so as to decrease with an increase of the target air/fuel ratio coefficient KCMD is determined by table lookup. Here, the target air/fuel ratio coefficient KCMD is proportional to the inverse number of the air/fuel ratio (A/F), that is, fuel/air ratio (F/A), and a value corresponding to the theoretical air/fuel ratio is 1.0.

Then, the flow proceeds to step S102, a value obtained by multiplying a basic fuel injection quantity TIM set depending on the speed NE of the internal combustion engine body 1 and the absolute pressure within intake pipe PBA, the target air/fuel ratio coefficient KCMD, engine rotation speed NE, and the air flow rate conversion factor KQAIR, is set as the air flow rate QAIR. Here, the air flow rate QAIR is a flow rate supplied to the internal combustion engine body 1.

Next, the flow proceeds to step S103, and it is determined whether the purge execution permission flag value F_PGACT for determining whether it is to be permitted or not to activate the purge control valve 44 to execute purge, is "1" or not. Purge execution permission is set depending on, for example, cooling water temperature of the internal combustion engine body 1 or the like.

If it is determined that the determination result is "NO", that is, if it is determined that purge execution is to be suspended, processing in step S120 and onward described later is performed.

On the other hand, if it is determined that the determination result in step S103 is "YES", that is, if purge execution is permitted, the flow proceeds to step S104, and it is determined whether the flag value of the fuel supply suspension execution flag F_FC is "1" or not.

If it is determined that the determination result is "YES", that is, if it is determined that fuel supply to the internal combustion engine body 1 has been suspended, the flow proceeds to step S105.

In step S105, 0% is set to a target purge control valve drive duty value PGCMD which is described later, to proceed to step S106, and then in step S106, 0 is set to the target purge flow rate QPGC to proceed to step S107. Here, the target purge control valve drive duty value is the duty ratio when the purge control valve is driven by, for example PWM.

In step S107 shown in FIG. 9, it is determined whether a purge flow rate restriction coefficient for determination KPGTJUD is equal to or below the purge flow rate restriction coefficient KPGT or not.

If it is determined that the determination result is "NO", processing in step S128 and onward described later is performed. On the other hand, if it is determined that the determination result is "YES", the flow proceeds to step S108, and the purge flow rate restriction coefficient KPGT is set to the purge flow rate restriction coefficient for determination KPGTJUD, to proceed to step S128 described later.

The purge flow rate restriction coefficient for determination KPGTJUD is for holding the value of the purge flow rate restriction coefficient KPGT before suspension, for example, when execution of purge is temporarily suspended and then resumed again.

On the other hand, if it is determined that the determination result in step S104 is "NO", the flow proceeds to step S109.

In step S109, it is determined whether the flag value of a full admission increase execution flag F_WOT is "1" or not.

If it is determined that the determination result is "YES", the flow proceeds to step S111 described later. On the other hand, if it is determined that the determination result is "NO", the flow proceeds to step S110.

In step S110, it is determined whether the flag value of a feedback control execution flag F_LAFFB for feedback controlling the air/fuel ratio of the internal combustion engine body 1 to the target air/fuel ratio, for example, by PID control, based on the output from the LAF sensor 17, is "1" or not.

If it is determined that the determination result is "NO", the flow proceeds to step S105. On the other hand, if it is determined that the determination result is "YES", the flow proceeds to step S111.

In step S111, it is determined whether the flag value of an idle stop flag F_IDLSTP is "1" or not.

Here, idle stop is a processing for reducing consumption of fuel by stopping fuel supply to the internal combustion engine body 1 by the ECU 5, to thereby stop the internal combustion engine body 1, and to inhibit unnecessary idle operation.

As a case where "1" is set to the flag value of the idle stop flag F_IDLSTP, for example, there is a case where, for example, at the time of deceleration of a vehicle, after the vehicle speed V has reached a predetermined vehicle speed (including 0), the shift position is in the neutral or P (parking), or a case where even if the shift position is in the D (drive) position or in the R (reverse) position, the brake pedal is pressed. However, it is determined whether the internal combustion engine body 1 can be re-started or not by operating a starter motor (not shown), even if the internal combustion engine body is stopped, and if there is no reserve electric power, the internal combustion engine body 1 is not stopped, and the idle operating condition is maintained.

As a case where the internal combustion engine body 1 is re-started from the idle stop condition, for example, there is a case where the clutch switch (not shown) becomes an ON state, and the shift position is in the in-gear state, and the starter motor is automatically driven by the ECU 5 to start the internal combustion engine body 1. If it is determined that the determination result in step S111 is "YES", that is, if it is determined that idle stop of the internal combustion engine body 1 is now under execution, the flow proceeds to step S105.

On the other hand, if it is determined that the determination result is "NO", that is, if it is determined that idle stop of the internal combustion engine body 1 is not executed, PGCMD calculation processing described later is executed to proceed to step S113.

That is to say, when the internal combustion engine body 1 shifts to the idle stop condition, execution of purge is stopped, to thereby suppress the air from flowing into the internal combustion engine body 1, enabling prevention of the occurrence of a so-called dieseling phenomenon resulting from the air being compressed, and also enabling suppression of the occurrence of vibration in the internal combustion engine body 1.

In step S113 shown in FIG. 9, it is determined whether the target purge control valve drive duty value PGCMD is equal to or above the predetermined high-side purge control valve drive duty threshold #DOUTPGH (for example, 100%) or not.

If it is determined that the determination result is "YES", that is, if it is determined that the target purge control valve drive duty value PGCMD is overflowing, the flow proceeds to step S114, where the predetermined high-side purge control valve drive duty threshold #DOUTPGH is set to the purge control valve drive duty value DOUTPG, to proceed to step S117, which is described later.

On the other hand, if it is determined that the determination result in step S113 is "NO", that is, if it is determined that the target purge control valve drive duty value PGCMD is not overflowing, the flow proceeds to step S115, where it is determined whether the target purge control valve drive duty value PGCMD is equal to or below a predetermined low-side purge control valve drive duty threshold #DOUTPGL (for example, 0%) or not.

If it is determined that the determination result is "YES", that is, if it is determined that the target purge control valve drive duty value PGCMD is underflowing, the flow proceeds to step S128, which is described later.

On the other hand, if it is determined that the determination result in step S115 is "NO", that is, if it is determined that the target purge control valve drive duty value PGCMD is not underflowing, the flow proceeds to step S116, where the target purge control valve drive duty value PGCMD is set to the purge control valve drive duty value DOUTPG, to proceed to step S117.

In step S117, a predetermined timer value #TMPGOFF (for example, 1.0s) is set to an after-purge completion predetermined time detection timer TMPGOFF, to proceed to step S118.

In step S118, a value obtained by dividing a value, obtained by subtracting a purge control valve drive duty value voltage correction DPGCVB from the purge control valve drive duty value DOUTPG, by an initial target purge control valve drive duty value PGCMD0, is set to a purge control valve drive duty value ratio PGRATE.

Here, the purge control valve drive duty value voltage correction DPGCVB is for correcting a rise delay of the purge control valve drive duty value DOUTPG depending on the voltage supplied to the purge control valve 44, and is set so as to decrease with an increase in the voltage supplied to the purge control valve 44.

Next, in step S119, a value obtained by dividing the target purge flow rate QPGC by a target purge flow rate basic value QPGCBASE, is set to the target purge flow rate ratio QRATE, to thereby terminate a series of processing.

Moreover, in step S120 shown in FIG. 8, 0% is set to the purge control valve drive duty value DOUTPG. Then, 0% is set to the target purge control valve drive duty value PGCMD (step S121), and 0 is set to the target purge flow rate QPGC (step S122), to proceed to step S123.

In step S123, a predetermined flow rate restriction coefficient at the time of starting the purge #KPGTINI (for example, 0.120) is set to the purge flow rate restriction coefficient KPGT. Then, a predetermined after-startup update timer value #TMPGT0 (for example, 10s) is set to a purge flow rate restriction coefficient KPGT update timer TMPGT (step S124), and a predetermined timer value #TMPGOFF (for example, 1.0s) is set to an after-purge completion predetermined time detection timer TMPGOFF (step S125), to proceed to step S126.

In step S126, "0" is set to the flag value of a purge flow rate restriction coefficient KPGT calculation execution flag F_KPGTON. Then, 0 is set to the purge flow rate restriction coefficient for determination KPGTJUD (step S127), to thereby perform processing in step S135 and onward described later.

Moreover, in step S128, it is determined whether the flag value of a purge flow rate restriction coefficient KPGT calculation execution flag F_KPGTON is "1" or not.

If it is determined that the determination result is "NO", for example, just after startup of the internal combustion engine body 1, or at the time of purge execution, such as, just after restart of purge after the execution of purge has been temporarily suspended, if the purge flow rate restriction coefficient KPGT is not being calculated, a predetermined update timer value #TMPGTS0 (for example, 5s) is set to the purge flow rate restriction coefficient KPGT update timer TMPGT (step S129), and then a predetermined flow rate restriction coefficient at the time of starting the purge #KPGTINI (for example, 0.102) is set to the purge flow rate restriction coefficient KPGT (step S130), to thereby perform processing in step S134 and onward described later.

On the other hand, if it is determined that the determination result in step S128 is "YES", that is, in the case of calculating the purge flow rate restriction coefficient KPGT, such as at the time of starting purge execution, then a predetermined update timer value #TMPGTS (for example, 0.3s) is set to the purge flow rate restriction coefficient KPGT update timer TMPGT (step S131), and then it is determined whether the purge flow rate restriction coefficient KPGT is equal to or above a predetermined purge restarting flow rate restriction coefficient #KPGTREST (for example, 0.320) or not (step S132).

If it is determined that the determination result is "NO", processing in step S134 and onward described later is performed. On the other hand, if it is determined that the determination result is "YES", the predetermined purge restarting flow rate restriction coefficient #KPGTREST (example, 0.320) is set to the purge flow rate restriction coefficient KPGT (step S133), and the flow proceeds to step S134.

In step S134, 0% is set to the purge control valve drive duty value DOUTPG to proceed to step S135.

In step S135, 0 is set to the purge control valve drive duty value ratio PGRATE. Then, 0 is set to the target purge flow rate ratio QRATE (step S136), to thereby terminate a series of processing.

The PGCMD calculation processing in the above described step S112 will now be described with reference to the accompanying drawings. In this processing, the target purge flow rate QPGC is calculated, and the target purge control valve drive duty value PGCMD is also calculated based on the target purge flow rate QPGC. Hereinafter, processing for calculating the target purge flow rate QPGC is specifically described.

At first, in step S201 shown in FIG. 10, a value obtained by multiplying the air flow rate QAIR by a predetermined target purge rate #KQPGB (for example, 0.150), is set to the target purge flow rate basic value QPGCBASE, to proceed to step S202.

Here, the target purge rate #KQPGB is a correction coefficient for correcting the purge flow rate change depending on the absolute air intake passage pressure PBA, even if the degree of opening of the purge control valve 44 is a constant value.

In step S202, it is determined whether the target purge flow rate basic value QPGCBASE is larger than a predetermined purge flow rate upper limit #QPGMAX (for example, 35 liter/min) or not.

If it is determined that the determination result is "YES", the flow proceeds to step S203, where a purge flow rate upper limit #QPGMAX is set to the target purge flow rate value QPGCMD, and the flow proceeds to step S207 described later.

On the other hand, if it is determined that the determination result in step S202 is "NO", the flow proceeds to step S204, where it is determined whether the target purge flow rate basic value QPGCBASE is smaller than a predetermined purge flow rate lower limit #QPGMIN (for example, 0) or not.

If it is determined that the determination result is "YES", the flow proceeds to step S205, where a purge flow rate lower limit #QPGMIN is set to the target purge flow rate value QPGCMD, and the flow proceeds to step S207 described later.

On the other hand, if it is determined that the determination result in step S204 is "NO", the flow proceeds to step S206, where the target purge flow rate basic value QPGCBASE is set to the target purge flow rate value QPGCMD, and the flow proceeds to step S207.

In step S207, it is determined whether the flag value of an idle operation flag F_IDLE is "1" or not.

If it is determined that the determination result is "NO", that is, if it is determined that the internal combustion engine body 1 is not in the idle operating condition, the flow proceeds to step S213 described later.

On the other hand, if it is determined that the determination result in step S207 is "YES", the flow proceeds to step S208, and as shown in FIG. 13, a low altitude side purge restriction coefficient #KPGTSPL and a high altitude side purge restricting coefficient #KPGTSPH which are set so as to decrease with an increase of the purge correction coefficient KAFEVACT are obtained by table lookup.

As shown in FIG. 13, since the both purge restricting coefficients #KPGTSPLIH are set so as to decrease with an increase of the purge correction coefficient KAFEVACT, when the purge concentration is high, the purge flow rate is decreased, and the situation where the minimum requirement value of fuel cannot be secured because the valve opening time of the fuel injection valves 12 becomes short, is prevented.

In step S209, as shown in FIG. 14, respective lowland side and high altitude side purge restricting coefficient detection values #KPGTSPL/H are made to correspond sequentially to a predetermined lowland side lattice point #PAKPGTL (for example, 61.3 kPa) and a high altitude side lattice point #PAKPGTH (97.3 kPa) associated with the atmospheric pressure PA, and are calculated by interpolation with respect to a proper value of the atmospheric pressure PA, to thereby determine the purge restricting coefficient KPGTSP.

That is to say, for example, on the high altitude, the fuel value during idle operation decreases, and hence the purge restricting coefficient KPGTSP is decreased.

Next, in step S210, it is determined whether the purge flow rate restriction coefficient KPGT is equal to or below the purge restricting coefficient KPGTSP or not.

If it is determined that the determination result is "NO", the flow proceeds to step S211 shown in FIG. 11, where the purge restricting coefficient KPGTSP is set to the purge flow rate restriction coefficient KPGT, and the purge restricting coefficient KPGTSP is set to the purge flow rate restriction coefficient for determination KPGTJUD (step S212), to thereby perform the processing in step S216 and onward described later.

On the other hand, if it is determined that the determination result in step S210 is "YES", the flow proceeds to step S213, where it is determined whether the purge flow rate restriction coefficient KPGT update timer TMPGT is 0 or not.

If it is determined that the determination result is "NO", the processing in step S227 and onward described later is performed.

On the other hand, if it is determined that the determination result in step S213 is "YES", the flow proceeds to step S214 shown in FIG. 11, where "1" is set to the flag value of the purge flow rate restriction coefficient KPGT calculation execution flag F_KPGTON.

Then, a value obtained by adding a predetermined addition value #DKPGT (for example, 0.008) to the purge flow rate restriction coefficient KPGT, is set as a new purge flow rate restriction coefficient KPGT (step S215), and the flow proceeds to step S216.

In step S216, it is determined whether the purge flow rate restriction coefficient KPGT is larger than "1.0" or not.

If it is determined that the determination result is "NO", the flow proceeds to step S218 described later. On the other hand, if it is determined that the determination result is "YES", "1.0" is set to the purge flow rate restriction coefficient KPGT (step S217), and the flow proceeds to step S218.

In step S218, it is determined whether the purge flow rate restriction coefficient KPGT is equal to or above the purge flow rate restriction coefficient for determination KPGTJUD or not.

If it is determined that the determination result is "NO", the flow proceeds to step S219, where it is determined whether the flag value of the idle operation flag F_IDLE is "1" or not.

If it is determined that the determination result in step S219 is "YES", a predetermined update timer value #TMPGTSI (for example, 2.8s) is set to the purge flow rate restriction coefficient KPGT update timer TMPGT (step S220), to thereby perform processing in step S227 and onward described later.

On the other hand, if it is determined that the determination result in step S219 is "NO", a predetermined update timer value #TMPGTS (for example, 0.3s) is set to the purge flow rate restriction coefficient KPGT update timer TMPGT (step S221), to thereby perform the processing in step S227 and onward described later.

Moreover, if it is determined that the determination result in step S218 is "YES", the flow proceeds to step S222, where it is determined whether the flag value of the idle operation flag F_IDLE is "1" or not.

If it is determined that the determination result in step S222 is "YES", as shown in FIG. 12, an update timer detection value TMPGTLI is obtained by table lookup of an update timer value #TMPGTLI which is set so as to increase with an increase of the purge correction coefficient KAFEVACT (step S223).

Then, the update timer detection value #TMPGTLI is set to the purge flow rate restriction coefficient KPGT update timer TMPGT (step S224), to thereby perform the processing in step S227 and onward described later.

On the other hand, if it is determined that the determination result in step S222 is "NO", as shown in FIG. 12, the update timer detection value TMPGTL is obtained by table lookup of an update timer value #TMPGTL which is set so as to increase with an increase of the purge correction coefficient KAFEVACT (step S225). Then, the update timer detection value #TMPGTL is set to the purge flow rate restriction coefficient KPGT update timer TMPGT (step S226), and the flow proceeds to step S227.

In step S227, a value obtained by multiplying the target purge flow rate value QPGCMD by the purge flow rate restriction coefficient KPGT, is set to the target purge flow rate QPGC, to thereby terminate a series of processing.

That is to say, if the purge flow rate restriction coefficient KPGT gradually increases, and becomes equal to the purge restriction coefficient KPGTSP, the update speed of the purge flow rate restriction coefficient KPGT is decreased. Moreover, in the idle operating condition, the update speed of the purge flow rate restriction coefficient KPGT is decreased.

According to the vaporized fuel treatment apparatus 40 of the internal combustion engine according to this embodiment, when the internal combustion engine body 1 shifts to the idle stop condition, the purge control valve 44 is closed to thereby stop the execution of purge. The dieseling phenomenon where for example air flows into the internal combustion engine body 1 and is compressed, is thus prevented from occurring, thereby enabling suppression of vibration occurring in the internal combustion engine body 1.

Moreover, in the idle operating condition, the timer value set to the purge flow rate restriction coefficient KPGT update timer TMPGT is made to be a large value, to thereby decrease the update speed of the purge flow rate restriction coefficient KPGT, and to suppress the vaporized fuel purged from the canister 45 from abruptly flowing into the internal combustion engine body 1. Hence it is possible to prevent the situation where the rotation of the internal combustion engine body 1 becomes unstable and, for example, the engine rotation speed NE decreases, or the operation of the internal combustion engine body 1 is stopped.

As described above, according to the vaporized fuel treatment apparatus of an internal combustion engine of the present invention according to the first aspect of the invention, even if the operation of the internal combustion engine is stopped, since the purge valve is closed by the purge control device, the air can be prevented from flowing into the internal combustion engine, to thereby prevent the occurrence of a dieseling phenomenon. As a result, unpleasant vibration or the like can be prevented from being generated in the internal combustion engine.

Moreover, according to the vaporized fuel treatment apparatus of an internal combustion engine of the present invention according to the second aspect of the invention, if it is determined that the internal combustion engine is in the idle state by the idle detection device, the time period for increasing the degree of purge valve opening is extended, to thereby suppress the vaporized fuel from abruptly flowing into the internal combustion engine. Hence the situation where the rotation of the internal combustion engine becomes unstable can be prevented.

What is claimed is:

1. A vaporized fuel treatment apparatus of an internal combustion engine comprising:

a canister for adsorbing vaporized fuel generated in a fuel tank;

a purge control device for controlling opening of a purge valve disposed in a path connecting said canister and an engine intake system of said internal combustion engine; and a stop device for stopping said internal combustion engine when an idle stop condition of said internal combustion engine is established;

wherein said purge control device closes said purge valve when said stop condition is established.

2. A vaporized fuel treatment apparatus of an internal combustion engine comprising:

a canister for adsorbing vaporized fuel generated in a fuel tank;

a purge control device disposed in a path connecting said canister and an engine intake system of said internal combustion engine for opening a purge valve at each predetermined time after purging is started; and an idle detection device for detecting whether or not said internal combustion engine is in an idle state;

wherein, when it is determined by said idle detection device that the internal combustion engine is in the idle state, said purge control device increases an interval of opening said purge valve at each predetermined time, the interval between which is set longer than for said predetermined time set when said internal combustion engine is not in the idle state.

3. A vaporized fuel treatment method of an internal combustion engine comprising the steps of:

removing by a purge control device vaporized fuel by purging the vaporized fuel generated in a fuel tank through a canister to an engine intake system of the internal combustion engine at a predetermined time interval; and stopping a purging operation by a stop device when it is determined that an idle stop condition of said internal combustion engine is established.

4. A vaporized fuel treatment method of an internal combustion engine comprising the steps of:

removing by said purge control device said vaporized fuel by purging the vaporized fuel generated in the fuel tank through said canister to the engine intake system of the internal combustion engine at a predetermined time interval;

detecting by an idle detection device whether or not said internal combustion engine is in an idle state; and increasing an interval of opening said purge valve at each predetermined time, the interval between which is set longer than for said predetermined time set when said internal combustion engine is not in the idle state when it is determined by said idle detection device that the internal combustion engine is in the idle state.

5. A computer readable recording medium including a program for executing a vaporized fuel treatment method of an internal combustion engine comprising the steps of:

removing by a purge control device vaporized fuel by purging the vaporized fuel generated in a fuel tank through a canister to an engine intake system of the internal combustion engine at a predetermined time interval; and stopping a purging operation by a stop device when it is determined that an idle stop condition of said internal combustion engine is established.

6. A computer readable recording medium including a program for executing a vaporized fuel treatment method comprising the steps of:

removing by said purge control device said vaporized fuel by purging the vaporized fuel generated in the fuel tank through said canister to the engine intake system of the internal combustion engine at a predetermined time interval;

detecting by an idle detection device whether or not said internal combustion engine is in an idle state; and increasing an interval of opening said purge valve at each predetermined time, the interval between which is set longer than for said predetermined time set when said internal combustion engine is not in the idle state when it is determined by said idle detection device that the internal combustion engine is in the idle state.

* * * * *